US008017292B2

(12) United States Patent
Sabu et al.

(10) Patent No.: US 8,017,292 B2
(45) **Date of Patent: *Sep. 13, 2011**

(54) TONER, AS WELL AS IMAGE FORMING APPARATUS AND IMAGE FORMING METHOD USING THE SAME

(75) Inventors: Akiyoshi Sabu, Numazu (JP); Akihiro Kotsugai, Numazu (JP); Shinya Nakayama, Numazu (JP); Hiroshi Yamashita, Numazu (JP); Tsuyoshi Sugimoto, Mishima (JP); Hiroshi Yamada, Numazu (JP); Junichi Awamura, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 619 days.

This patent is subject to a terminal disclaimer.

(21) Appl. No.: 12/112,601

(22) Filed: Apr. 30, 2008

(65) Prior Publication Data

US 2008/0280218 A1 Nov. 13, 2008

(30) Foreign Application Priority Data

May 11, 2007 (JP) ..... 2007-127410

(51) Int. Cl.
*G03G 9/087* (2006.01)

(52) U.S. Cl. ..... 430/109.4; 430/110.1; 430/110.2; 430/110.3

(58) Field of Classification Search ..... 430/109.4, 430/110.1, 110.2, 110.3
See application file for complete search history.

(56) References Cited

U.S. PATENT DOCUMENTS

2005/0074685 A1* 4/2005 Kido et al. ..... 430/110.2
2007/0092822 A1* 4/2007 Matsumura et al. ..... 430/109.4
2007/0248380 A1 10/2007 Iwamoto et al.
2007/0281236 A1 12/2007 Watanabe et al.
2007/0281237 A1 12/2007 Iwamoto et al.
2008/0280218 A1* 11/2008 Sabu et al. ..... 430/48

FOREIGN PATENT DOCUMENTS

JP 2007-279652 10/2007
WO WO 2007/123273 A1 11/2007

OTHER PUBLICATIONS

U.S. Appl. No. 11/943,972, filed Nov. 21, 2007, Shinya Nakayama, et al.
U.S. Appl. No. 11/943,929, filed Nov. 21, 2007, Shinya Nakayama, et al.
U.S. Appl. No. 12/203,278, filed Sep. 3, 2008, Yamada, et al.
U.S. Appl. No. 12/253,558, filed Oct. 17, 2008, Nakayama, et al.

* cited by examiner

*Primary Examiner* — Hoa V Le
(74) *Attorney, Agent, or Firm* — Oblon, Spivak, McClelland, Maier & Neustadt, L.L.P.

(57) ABSTRACT

To provide a toner produced by emulsifying or dispersing in an aqueous medium particles containing at least polyester resin particles and by aggregating the polyester resin particles, wherein the polyester resin particles contain a polyester resin, the polyester resin is produced by condensation polymerization of an alcohol component containing 65 mol % or more 1,2-propanediol in a dihydroxy alcohol component and a carboxylic acid component containing purified rosin, and the softening point of the polyester resin is 80° C. or more and less than 120° C., and wherein the toner comprises a colorant and a releasing agent.

10 Claims, 5 Drawing Sheets

TONER, AS WELL AS IMAGE FORMING APPARATUS AND IMAGE FORMING METHOD USING THE SAME

BACKGROUND OF THE INVENTION

1. Field of the Invention

The present invention relates to a toner for developing electrostatic images in electrophotography, electrostatic recording, and electrostatic printing, as well as to an image forming apparatus and image forming method using the toner.

2. Description of the Related Art

It has been proposed so far that, in order to improve low temperature-fixing property of toner, polyester resins are used as binder resins for toner (see Japanese Patent Application Publication (JP-B) No. 05-82943 and Japanese Patent (JP-B) No. 3051767). However, in order further to improve the low temperature-fixing property of toner, it is necessary to reduce the average molecular weight and glass transition temperature of polyester resins, which causes a problem of reduced blocking resistance of toner under high-temperature and high-humidity conditions.

As a toner production method, a pulverization method is widely used in which additives such as a colorant, wax and so forth are added in a binder resin, the resultant mixture is heated, melted and kneaded, and the kneaded product thus obtained is cooled, pulverized and classified to produce toner particles with given particle diameters.

The pulverization method, however, has such problems as large variations between particle diameters of the produced toner particles, poor productivity, high costs and, particularly upon production of small-diameter toner particles, very low yields.

Consequently, in recent years, an emulsification polymerization aggregation method has been attracting attention as a toner production method in which the shape and particle size distribution of toner can be arbitrarily controlled (see JP-B No. 3246394 and Japanese Patent Application Laid-Open (JP-A) No. 2001-305797).

Furthermore, recently, speeding up and saving of energy is requested for image forming apparatuses, however conventional binder resins for toners cannot afford such marketing needs, and binder resins with further improved low temperature-fixing property are requested. When the softening point of polyester resin is reduced in order to achieve the low temperature-fixing property satisfying the marketing needs, toner particles tend to aggregate, resulting in poor storage stability. In addition such a toner often causes thermal fixing (filming) and so forth due to poor dispersion of releasing agent.

When a toner is produced by the emulsification polymerization aggregation method using the polyester resins, a dispersion of fine resin particles is prepared by emulsification polymerization. Meanwhile, a dispersion of fine colorant particles and a dispersion of wax as a releasing agent are prepared. A toner is produced by mixing these dispersions, adding a flocculant such as an inorganic metal salt to the resultant mixture with stirring to aggregate the fine resin particles and the fine colorant particles and so forth, and heating them for fusing.

However, the toner production method described above results in uneven dispersing of colorant and wax in the toner, causing them to be aggregated and exposed on the toner surface leading to wax spent and resin spent to carrier particles. In addition this production method has other problems that since the charge amount of the toner varies, the image density also varies and fogging occurs in the formed image.

BRIEF SUMMARY OF THE INVENTION

An object of the present invention is to provide a toner which has excellent storage stability and low temperature-fixing property, causes little wax spent and resin spent to carrier particles, has excellent stability in charge amounts and causes little fogging, as well as an image forming apparatus and image forming method using the toner.

The above objective was achieved by the following means:

<1> A toner produced by emulsifying or dispersing in an aqueous medium particles containing at least polyester resin particles and by aggregating the polyester resin particles, wherein the polyester resin particles contain a polyester resin, the polyester resin is produced by condensation polymerization of an alcohol component containing 65 mol % or more 1,2-propanediol in a dihydroxy alcohol component and a carboxylic acid component containing purified rosin, and the softening point of the polyester resin is 80° C. or more and less than 120° C., and wherein the toner includes at least a colorant and a releasing agent.

<2> The toner according to item <1>, wherein the carboxylic acid component further contains an aliphatic dicarboxylic acid compound having 2 to 4 carbon atoms.

<3> The toner according to any one of items <1> and <2>, wherein the alcohol component further contains glycerin.

<4> The toner according to any one of items <1> to <3>, wherein the toner includes at least as a core-shell structure a core part formed of core particles containing resin particles A for cores, and a shell part formed of fine shell particles containing resin particles B for shells.

<5> The toner according to any one of items <1> to <4>, wherein the toner is produced by a method which includes at least: forming core particles by aggregating resin particles A for cores containing the polyester resin particles by heating; forming shell-coated particles in which fine shell particles are attached to surfaces of the core particles by adding to a dispersion of the core particles fine shell particles containing resin particles B for shells; and heating the shell-coated particles.

<6> The toner according to any one of items <4> to <5>, wherein the resin particles B contain polyester resin particles.

<7> The toner according to any one of items <1> to <6>, further including at least: an external additive made of fine inorganic particles attached to toner surfaces, wherein the fine inorganic particles contain fine silica particles having a hydrophobizing degree of 50% or more and a BET specific surface area of 100 $m^2/g$ to 300 $m^2/g$, and fine titania particles having a hydrophobizing degree of 50% or more and a BET specific surface area of 20 $m^2/g$ to 150 $m^2/g$.

<8> The toner according to item <7>, wherein the fine inorganic particles contain silica particles of an average primary particle diameter of 60 nm to 150 nm and of approximately spherical shapes.

<9> The toner according to any one of items <1> to <8>, wherein the toner has a weight average particle diameter ($D_4$) of 3.0 μm to 7.0 μm, and the ratio of the weight average particle diameter ($D_4$) to the number average particle diameter (Dn) ($D_4$/Dn) is 1.05 to 1.30.

<10> The toner according to any one of items <1> to <9> wherein the toner has an average circularity of 0.93 to 0.99.

<11> An image forming apparatus, including at least a latent electrostatic image bearing member, a latent electrostatic image forming unit configured to form a latent electrostatic image on the latent electrostatic image bearing member, a developing unit configured to form a visible image by developing the latent electrostatic image with a toner, a transferring unit configured to transfer the visible images onto a recording medium, a fixing unit configured to fix the visible image to the recording medium, and a cleaning unit configured to remove residual toner particles on the latent electrostatic image bearing member, wherein the cleaning unit is equipped with an elastic blade, and the toner is a toner according to any one of items <1> to <10>.

<12> The image forming apparatus according to item <11>, wherein a toner fixing member in the fixing unit is any one of a belt and a sheet.

<13> An image forming method, including at least: forming a latent electrostatic image on a latent electrostatic image bearing member; developing the latent electrostatic image with a toner to form a visible image; transferring the visible image onto a recording medium; fixing the visible image to the recording medium; and removing residual toner particles on the latent electrostatic image bearing member with a blade, wherein the toner is a toner according to any one of items <1> to <10>.

<14> A developer including the toner according to any one of items <1> to <10>.

<15> A toner container including therein the toner according to any one of items <1> to <10>.

<16> A process cartridge including at least a latent electrostatic image bearing member, a developing unit configured to form a visible image by developing a latent electrostatic image formed on the latent electrostatic image bearing member with a toner, wherein the process cartridge is detachably mounted on the main body of an image forming apparatus; and the toner is a toner according to any one of items <1> to <10>.

The toner according to the present invention is produced by emulsifying or dispersing in an aqueous medium particles containing at least polyester resin particles and by aggregating them, wherein the polyester resin particles contain polyester resins; the polyester resins are produced by subjecting to condensation polymerization an alcohol component which contains 65 mol % or more 1,2-propanediol in the component of dihydroxy alcohols and a carboxylic acid component containing purified rosin; the softening point of the polyester resins is 80° C. or more and less than 120° C.; and the toner contains at least a colorant and a releasing agent.

In the toner according to the present invention, the polyester resins constituting the polyester resin particles are obtained by condensation polymerization of an alcohol component containing 1,2-propanediol as a dihydroxy alcohol component and a carboxylic acid component containing purified rosin. 1,2-Propanediol used as an alcohol component is a branched-chain alcohol with 3 carbon atoms, is effective in improving low temperature-fixing property of a toner with offset resistance being maintained compared to alcohols with 2 or less carbon atoms, and is effective in preventing degradation of storage stability due to decreased glass transition temperature compared to branched-chain alcohols with 4 or more carbon atoms. Furthermore since purified rosin is mixed in the carboxylic acid component, fixing at a very low temperature becomes possible. Since an ester component is abundant in these polyester resins compared to conventional polyester resins, miscibility with releasing agent and so forth becomes excellent. Consequently, the toner of the present invention has an excellent dispersibility with a releasing agent and so forth, causes no separation of a resin phase, has an excellent durability, and produces low temperature-fixing property with heat-resistance/storage stability of resins being improved. Furthermore, in the toner of the present invention, by using purified rosin, a foul odor originating from impurities is suppressed, resulting in excellent heat-resistance/storage stability.

In addition since the toner is produced by emulsifying or dispersing in an aqueous medium particles containing at least polyester resin particles and by aggregating them, the toner with small particle diameters and a sharp particle diameter distribution, which are advantageous for higher image quality, can be produced stably, and it becomes possible to control states with respect to one another of a binder resin, a releasing agent, and a colorant as is required and to bring out the properties of the binder resin effectively.

Therefore the toner according to the present invention has an excellent storage stability and low temperature-fixing property, causes small wax spent and resin spent to the carrier particles, has an excellent stability of the charge amounts, and can suppress the occurrence of fogs.

The image forming apparatus according to the present invention contains at least a latent electrostatic image bearing member, a charging unit configured to charge a surface of the latent electrostatic image bearing member, an exposing unit configured to form a latent electrostatic image by exposing charged surface of the latent electrostatic image bearing member to light, a developing unit configured to form a visible image by developing the latent electrostatic image with a toner, a transferring unit configured to transfer the visible images onto a recording medium, a fixing unit configured to fix the visible image to the recording medium, and a cleaning unit configured to remove the residual toner particles on the latent electrostatic image bearing member, wherein the cleaning unit is equipped with an elastic blade; and the toner is a toner according to the present invention.

In the image forming apparatus according to the present invention, the latent electrostatic image forming unit forms a latent electrostatic image. The developing unit forms a visible image by developing the latent electrostatic image formed on the latent electrostatic image bearing member with the toner. The transferring unit transfers the visible image onto a recording medium. The fixing unit fixes the visible image to the recording medium. The cleaning unit removes the residual toner particles on the latent electrostatic image bearing member. At this time, since a toner according to the present invention is used for the toner, wax spent and resin spent to carrier particles is small, excellent stability of charge amounts of the toner is obtained, and images without fogging and with very high quality can be formed.

The image forming method according to the present invention includes at least a latent electrostatic image forming step forming a latent electrostatic image on a latent electrostatic image bearing member, a developing step forming a visible image by developing the latent electrostatic image with toner, a transferring step transferring the visible image to a recording medium, a fixing step fixing the visible image to the recording medium, and a cleaning step removing the residual toner particles on the latent electrostatic image bearing member with a blade, wherein the toner is a toner according to the present invention.

In the image forming method according to the present invention, at the latent electrostatic image forming step, a latent electrostatic image is formed on the latent electrostatic image bearing member. At the developing step, the visible image is formed by developing the latent electrostatic image formed on the latent electrostatic image bearing member with the toner. At the transferring step, the visible image is transferred onto a recording medium. At the fixing step the visible image is fixed to the recording medium. At the cleaning step, the residual toner particles on the latent electrostatic image bearing member are removed using a blade. At this time, since a toner according to the present invention is used for the toner, wax spent and resin spent to carrier particles is small, excellent stability of charge amounts of the toner is obtained, and images without fogging and with very high quality can be formed.

DETAILED DESCRIPTION OF THE INVENTION

Figure 1:
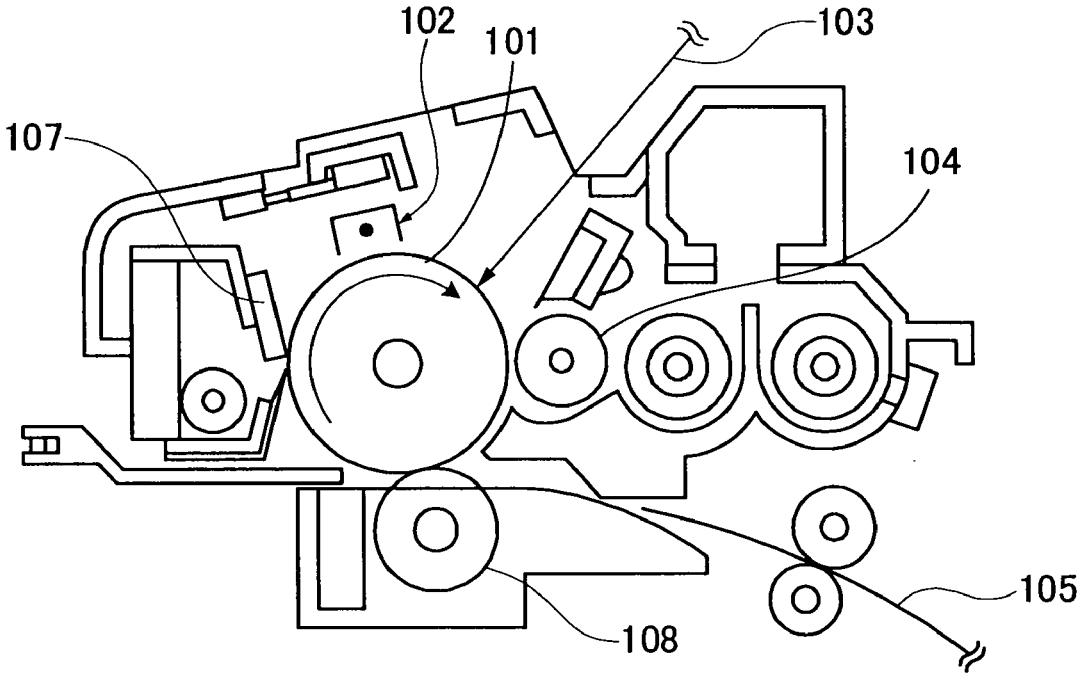
FIG. 1 is a schematic illustration showing an example of a process cartridge according to the present invention.

The toner according to the present invention is made by emulsifying or dispersing in an aqueous medium particles containing at least polyester resin particles and by aggregating them, and contains a colorant, a releasing agent, and the other components as required.

The above described toner particle preferably has a core-shell structure consisting of a core part formed of core particles containing resin particles A for cores and a shell part formed of fine shell particles containing resin particles B for shells.

<Polyester Resin Particle>

The polyester resin particles contain a polyester resin, which is produced by condensation polymerization of an alcohol component containing 65 mol % or more 1,2-propanediol in the total dihydroxy alcohol component and a carboxylic acid component containing purified rosin, and which has the softening point of 80° C. or more and less than 120° C.

—Alcohol Component—

1,2-Propanediol, a branched-chain alcohol with 3 carbon atoms, which is used for the alcohol component, is effective in improving the low temperature-fixing property of toner with offset resistance being maintained compared to alcohols with 2 or less carbon atoms. Furthermore, 1,2-propanediol is effective in preventing degradation of storage stability due to decreased glass transition temperature compared to branched-chain alcohols with 4 or more carbon atoms. Thus, 1,2-propanediol makes it possible to perform fixing at a very low temperature and improves storage stability improved, which is an extraordinary effect. In addition polyester resins containing 1,2-propanediol as an alcohol component have an excellent compatibility with releasing agents and are easily dispersed finely. In particular an excellent low temperature-fixing property and offset resistance are brought out when the amount of 1,2-propanediol in the dihydroxy alcohol component is 65 mol % or more.

Alcohols other than 1,2-propanediol may be contained in the alcohol component as far as the object, operation and effect of the present invention are not impaired. The amount of 1,2-propanediol in the total dihydroxy alcohol component is 65 mol % or more, preferably 70 mol % or more, more preferably 80 mol % or more, and still more preferably 90 mol % or more. Dihydroxy alcohol components other than 1,2-propanediol include aliphatic dihydroxy alcohols such as 1,3-propanediol, ethylene glycols with different numbers of carbon atoms, hydrogenated bisphenol-A or alkylene (2 to 4 carbon atoms) oxide adducts (average addition mol number: 1 to 16) thereof.

The amount of the dihydroxy alcohol components in the alcohol component is preferably 60 mol % to 95 mol %, and more preferably 65 mol % to 90 mol %.

Alcohols other than 1,2-propanediol may be contained in the alcohol component as far as the effect of the present invention is not impaired. The amount of 1,2-propanediol in dihydroxy alcohol components is 65 mol % or more, preferably 70 mol % or more, more preferably 80 mol % or more, and further preferably 90 mol % or more. Dihydroxy alcohol components other than 1,2-propanediol include propanediol with a different number of carbon atoms, ethylene glycol, hydrogenated bisphenol-A or alkylene (2 to 4 carbon atoms) oxide adducts (average addition mol number: 1 to 16) thereof. The amount of the dihydroxy alcohol components in the alcohol component is preferably 60 mol % to 100 mol %, more preferably 60 mol % to 95 mol %, and still more preferably 65 mol % to 90 mol %.

—Carboxylic Acid Component—

As the carboxylic acid component, purified rosin is used. Using purified rosin makes fixing at a very low temperature possible and since an ester component is abundant in these polyester resins compared to conventional polyester resins, miscibility with a releasing agent and so forth becomes excellent. Consequently, the toner of the present invention has an excellent dispersibility with a releasing agent, causes no separation of a resin phase, has an excellent durability, and produces low temperature-fixing property with heat-resistance/storage stability of resins being improved. Furthermore, in the toner of the present invention, by using purified rosin, a foul odor originating from impurities is suppressed, resulting in excellent heat-resistance/storage stability.

The rosin is a natural resin obtained from pines and its main components are resin acids such as abietic acid, neoabietic acid, parastric acid, pimaric acid, isopimaric acid, sandaracopimaric acid, and dehydroabietic acid, or a mixture thereof.

The rosins are classified broadly into 3 categories, that is tall rosin obtained from tall oil, a by-product in pulp production, gum rosin obtained from raw pine resin, and wood rosin obtained from pine stumps. The rosin used in the present invention is preferably tall rosin in terms of low temperature-fixing property.

Although purified products of modified rosin such as disproportionation rosin and hydrogenated rosin may be used, in the present invention unmodified, so-called raw rosin is preferably used in terms of low temperature-fixing property and storage stability.

The purified rosin described above is a rosin from which impurities are removed by purification processes. Examples of main impurities include, 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl) benzene, 3,5-dimethyl-2-cyclohexene, and 4-(1-methylethyl) benzaldehyde. In the present invention, peak strength of three types of impurities, that is, 2-methylpropane, pentanoic acid and benzaldehyde among these, detected as volatile components by headspace GC-MS may be used as indicators of purified rosin. Instead of absolute amounts of impurities, volatile components of impurities are used as the indicators, because one of the object of the present invention is, by using the purified rosin, to have improved odors compared to conventional polyester resins using rosins.

The purified rosin is defined as rosin which has peak strength of hexanoic acid of $0.8\times10^7$ or less, peak strength of pentanoic acid of $0.4\times10^7$ or less, and peak strength of benzaldehyde of $0.4\times10^7$ or less, under the measurement conditions of a headspace GC-MS described below. Furthermore, from the view point of storage stability and odor, peak strength of hexanoic acid is preferably $0.6\times10^7$ or less, and more preferably $0.5\times10^7$ or less. Peak strength of pentanoic acid is preferably $0.3\times10^7$ or less, and more preferably $0.2\times10^7$ or less. Peak strength of benzaldehyde is preferably $0.3\times10^7$ or less, and more preferably $0.2\times10^7$ or less.

Furthermore, from the view point of storage stability and odor, in addition to the above three types of impurities, in the purified rosin, concentrations of n-hexanal and 2-pentylfuran are preferably reduced. Peak strength of n-hexanal is preferably $1.7\times10^7$ or less, more preferably $1.6\times10^7$ or less, and still more preferably $1.5\times10^7$ or less. Peak strength of 2-pentylfuran is preferably $1.0\times10^7$ or less, more preferably $0.9\times10^7$ or less, and still more preferably $0.8\times10^7$ or less.

The purification method for the rosin is not particularly limited and known methods are available. The purification method includes distillation, recrystallization and extraction, and is preferably distillation. The distillation method, for which, for example, a method described in JP-A No. 07-286139 can be used, includes reduced-pressure distillation, molecular distillation, steam distillation and so forth, and preferably reduced-pressure distillation. For example the distillation is usually performed under a pressure of 6.67 kPa or less at a still temperature of 200° C. to 300° C., and methods of conventional simple distillation, film distillation, and rectification are applied to the distillation. Under the normal distillation conditions, a 2% by mass to 10% by mass macromolecule portion in the initial rosin is a pitch portion and removed, and at the same time as this a 2% by mass to 10% by mass initial boiling portion is removed.

The softening point of the purified rosin is preferably 50° C. to 100° C., more preferably 60° C. to 90° C., and still more preferably 65° C. to 85° C. By purification, impurities contained in the rosin are removed. The softening point of purified rosin in the present invention means the softening point determined when the rosin is melted once and cooled spontaneously under conditions of a temperature of 25° C. and a relative humidity of 50% for an hour according to the method described below.

The acid value of the purified rosin is preferably 100 mg KOH/g to 200 mg KOH/g, more preferably 130 mg KOH/g to 180 mg KOH/g, and still more preferably 150 mg KOH/g to 170 mg KOH/g.

The amount of the purified rosin in the carboxylic acid components is preferably 2 mol % to 50 mol %, more preferably 5 mol % to 40 mol %, and still more preferably 10 mol % to 30 mol %.

The carboxylic acid component preferably contains an aliphatic dicarboxylic acid having 2 to 4 carbon atoms. Examples of the aliphatic dicarboxylic acids compounds atoms include adipic acid, maleic acid, malic acid, succinic acid, fumaric acid, citraconic acid, itaconic acid, and anhydrides of these acids. The carboxylic acid component more preferably contains at least one aliphatic dicarboxylic acid selected from the group consisting of succinic acid, fumaric acid, citraconic acid and itaconic acid. These aliphatic dicarboxylic acids are effective in improving the low temperature-fixing property. In the present invention, itaconic acid is preferable among the aliphatic dicarboxylic acid compounds.

The amount of the aliphatic dicarboxylic acid in the carboxylic acid components is, in terms of improvement of low temperature-fixing property and prevention from decrease in the glass transition temperature, preferably 0.5 mol % to 20 mol %, and more preferably 1 mol % to 10 mol %.

The carboxylic acid component may contain a carboxylic acid compound other than the purified rosin, so far as the effects of the present invention are not impaired, and preferably contain an aromatic dicarboxylic acid such as phthalic acid, isophthalic acid, and terephthalic acid, in terms of securing the glass transition temperature. The amount of the aromatic dicarboxylic acid in the carboxylic acid components is preferably 40 mol % to 95 mol %, more preferably 50 mol % to 90 mol %, and still more preferably 60 mol % to 80 mol %.

The polyester resin is preferably a cross-linked polyester resin. A trivalent or more source monomer is preferably contained in at least any one of the alcohol components and the carboxylic acid components as a cross-linker. The amount of the trivalent or more source monomer in the total amount of alcohol components and carboxylic acid components is preferably 0 mol % to 40 mol %, and more preferably 5 mol % to 30 mol %.

In the trivalent or more source monomers, as a trivalent or more polyvalent carboxylic acid compound, for example, trimellitic acid or a derivative thereof is preferable. Examples of trivalent or more polyvalent alcohols include glycerin, pentaerythritol, trimethylolpropane, sorbitol, or alkylene (2 to 4 carbon atoms) oxide (average addition mol number: 1 to 16) adducts thereof. Among them, glycerin is particularly preferable, because it is effective in improving low temperature-fixing property as well as acts as a cross-linker. Based on this perspective, the alcohol components preferably contain glycerin. The amount of glycerin in the alcohol component is preferably 5 mol % to 40 mol %, and more preferably 10 mol % to 35 mol %.

—Esterification Catalyst—

Condensation polymerization of the alcohol components and the carboxylic acid components is preferably performed in the presence of an esterification catalyst. Examples of the esterification catalyst include, Lewis acids such as p-toluenesulfonic acid, titanium compounds, tin (II) compounds without a Sn—C bond. These are used alone or in combination of two. Among them, titanium compounds and tin (II) compounds without a Sn—C bond are particularly preferable.

For the titanium compound, a titanium compound having a Ti—O bond is preferable, and a titanium compound with an alkoxy group, an alkenyloxy group, or acyloxy group each having 1 to 28 total carbon atoms is more preferable.

Examples of the titanium compounds include titanium diisopropylate bistriethanolaminate [Ti $(C_6H_{14}O_3N)_2(C_3H_7O)_2$, titanium diisopropylate bisdiethanolaminate [Ti $(C_4H_{10}O_2N)_2(C_3H_7O)_2$], titanium dipentylate bistriethanolaminate [Ti $(C_6H_{14}O_3N)_2(C_5H_{11}O_2)$], titanium diethylate bistriethanolaminate [Ti $(C_6H_{14}O_3N)_2(C_2H_5O)_2$], titanium dihydroxyoctylate bistriethanolaminate [Ti $(C_6H_{14}O_3N)_2(OHC_8H_{16}O)_2$], titanium distearate bistriethanolaminate [Ti $(C_6H^{14}O_3N)_2(C_{18}H_{37}O)_2$], titanium triisopropylate triethanolaminate [Ti $(C_6H^{14}O_3N)_1(C_3H_7O)_3$], and is titanium monopropylate tris (triethanolaminate) [Ti $(C_6H_{14}O_3N)_3(C_3H_7O)_1$]. Among them, titanium diisopropylate bistriethanolaminate, titanium diisopropylate bisdiethanolaminate and titanium dipentylate bistriethanolaminate are particularly preferable and are, for example, also commercially available from MATSUMOTO TRADING CO., LTD.

Examples of the other preferable titanium compounds include tetra-n-butyl titanate [Ti $(C_4H_9O)_4$], tetrapropyl titanate [Ti $(C_3H_7O)_4$], tetrastearyl titanate [Ti $(C_{18}H_{37}O)_4$], tetramyristyl titanate [Ti $(C_{14}H_{29}O)_4$], tetraoctyl titanate [Ti $(C_8H_{17}O)_4$], dioctyldihydroxyoctyl titanate [Ti $(C_8H_{17}O)_2(OHC_8H_{16}O)_2$], and dimyristyldioctyl titanate [Ti $(C_{14}H_{29}O)_2(C_8H_{17}O)_2$]. Among them, tetrastearyl titanate, tetramyristyl titanate, tetraoctyl titanate, and dioctyldihydroxyoctyl titanate are preferable, can be obtained for example by reacting titanium halide with corresponding alcohol, and are commercially available from NISSO Co., Ltd.

The amount of a titanium compound per 100 parts by mass of the total amount of the alcohol component and the carboxylic acid component is preferably 0.01 parts by mass to 1.0 part by mass, and more preferably 0.1 parts by mass to 0.7 parts by mass.

The tin (II) compounds without a Sn—C bond is preferably tin (II) compounds with a Sn—O bond, tin (II) compounds with a Sn—X bond (where X represents a halogen atom) and so forth, and more preferably tin (II) compounds with a Sn—O bond.

Examples of the tin (II) compound with a Sn—O bond include a tin (II) carboxylate with a carboxylic acid group having 2 to 28 carbon atoms, such as tin (II) oxalate, tin (II) diacetate, tin (II) dioctanoate, tin (II) dilaurate, tin (II) distearate or tin (II) dioleate; dialkoxy tin (II) with an alkoxy group having 2 to 28 carbon atoms, such as dioctyloxy tin (II), dilauroxy tin (II), distearoxy tin (II) or dioleyloxy tin (II); tin (II) oxide; and tin (II) sulfate.

The compound with a Sn—X bond (where X represents a halogen atom) includes, for example, a tin (II) halide such as tin (II) chloride and tin (II) bromide. Among them, in terms of electrification rising effect and catalytic capacity, the tin (II) compound without a Sn—C bond is preferably tin (II) fatty acid represented by $(R^1COO)_2Sn$ (where $R^1$ represents an alkyl group or alkenyl group having 5 to 19 carbon atoms), dialkoxy tin (II) represented by $(R^2O)_2Sn$ (where $R^2$ represents an alkyl group or alkenyl group having 6 to 20 carbon atoms), and tin (II) oxide represented by SnO, more preferably tin (II) fatty acid represented by $(R^1COO)_2Sn$ and tin (II) oxide, and still more preferably tin (II) dioctanoate, tin (II) distearate, and tin (II) oxide.

The amount of the tin (II) compound without a Sn—C bond per is 100 parts by mass of the total amount of the alcohol component and the carboxylic acid component is preferably 0.01 parts by mass to 1.0 part by mass, and more preferably 0.1 parts by mass to 0.7 parts by mass.

When a combination of the titanium compound and the tin (II) compound without a Sn—C bond is used, the amount of the titanium compound and the tin (II) compound per 100 parts by mass of the total amount of the alcohol component and the carboxylic acid component is preferably 0.01 parts by mass to 1.0 part by mass, and more preferably 0.1 parts by mass to 0.7 parts by mass.

Condensation polymerization of the alcohol component and the carboxylic acid component can be performed, for example, in the presence of the esterification catalyst, in an atmosphere of an inactive gas, at a temperature of 180° C. to 250° C. The softening points of polyester based resins can be adjusted by the reaction time.

The polyester resins that are obtained by using 1,2-propanediol and the purified rosin, may be modified polyester resins. The modified polyester resin means a polyester resin grafted or blocked by phenol, urethane and so forth.

The softening point of the polyester resins is 80° C. or more and less than 120° C., and preferably 90° C. to 115° C., and more preferably 95° C. to 110° C. The softening point can be easily adjusted, for example, by polymerization time and so forth. When the softening point is lower than 80° C., heat resistance/storage stability degrades, and when the softening point is 120° C. or more, temperatures at which fixing is possible are disadvantageously raised.

Meanwhile, the glass transition temperature of the polyester resins is, in terms of fixing property, storage stability and durability, preferably 45° C. to 75° C., and more preferably 50° C. to 65° C. The acid values of the polyester resins are, in terms of electrostatic property and environmental stability, preferably 1 mgKOH/g to 80 mgKOH/g, and more preferably 10 mgKOH/g to 50 mgKOH/g.

A toner excellent both in low temperature-fixing property and storage stability can be obtained by using the polyester resins, which is obtained by using 1,2-propanediol and the purified rosin, as a binder resin for the toner.

<Core-shell Structure>

A toner particle according to the present invention preferably has core-shell structure, which makes improvement of fixing property and mechanical strength possible. In the following description of core-shell structure, the resin particles for cores are designated as A and the resin particles for shells are designated as B.

The toner particle having the core-shell structure may be produced by a toner production method including: a core particle forming step by aggregating resin particles A containing polyester resin particles while heating them for fixation; a shell coated-particle forming step by adding fine shell particles containing resin particles B into a dispersion of the core particles, mixing them and forming shell coated particles with the fine shell particles adhered onto the surfaces of the core particles; and a heating step by heating the shell coated particles with the shell particles adhered thereon.

The toner particles having the core-shell structure are obtained by attaching or fusion bonding resin particles B for shells to the surfaces of core particles obtained by aggregating or fusion bonding at least resin particles A for cores in an aqueous medium.

For resin particles B for shells making up a shell layer on the surface of core particles, a resin component softer than the resin particle A for cores and a resin component harder than the resin particle A for cores are used. By using the two resin components for resin particles B, the soft resin component acts as a fusion bonding enhancing component, can attach the hard resin component tightly on core particle surfaces and thus can form uniform shell layers, which makes toner particle surfaces smooth and produces uniform shell layers with high mechanical strength across the entire shell layers. Consequently, the toner structure having high durability against mechanical stresses in a developing device can be obtained.

The resin particles A for cores may be particles containing different resin components as separate particles, or may be composites particles containing in one particle different resin components as unique resin layers.

Similarly, the resin particles B for shells may be particles containing different resin components as separate particles, or may be composites particles containing in one particle different resin components as unique resin layers.

The resin particle A for cores may be composed not only of a single type of resin particle, but also of a plurality of resin particles of different molecular weights, such as high molecular weight resin particles a1 for cores, intermediate molecular weight resin particles a2 for cores, and low molecular weight resin particles a3 for cores, or of resin particles (composite resin particles) multi-stratified (complexed) with resins of different molecular weights such as resins for cores a1, a2, and a3 by multistage polymerization. Thus the core particles can be obtained by aggregating or fusion bonding a plurality of resin particles of different molecular weights and colorant particles, etc. as desired, or by aggregating or fusion bonding composite resin particles and colorant particles, etc. as desired.

The number average molecular weight (Mn) of resins over the total core particles are preferably 1,000 to 10,000, and more preferably 2,000 to 8,000. When the number average molecular weight (Mn) is 1,000 or more, the heat resistance/storage stability and offset resistance become favorable, when the number average molecular weight is 10,000 or less, the low temperature-fixing property of the toner becomes favorable.

When the number average molecular weight (Mn) is above 10,000, the fixing property sometimes becomes insufficient, when the number average molecular weight is less than 1,000, the blocking ability and storage stability of the toner sometimes degrade.

The resin particles A for cores are not particularly limited as far as they are resin particles capable of being stably dispersed in an aqueous medium. For the resin particles A for cores, known resin composition systems and production methods are applicable, and a styrene-acrylic copolymer resins and polyester resins are suitably used in terms of the fixing property and storage stability of the toner.

For the method for producing the styrene-acrylic copolymer resin, emulsification polymerization or suspension polymerization are appropriate. The polyester resin particles are easily obtained by dissolving previously given polymers in a solvent and suspending, emulsifying and dispersing the resultant solution in an aqueous medium. In particular when the low molecular weight component, high molecular weight component and intermediate molecular weight component are contained in a composite, resin particles obtained via multistage polymerization by the emulsification polymerization method is appropriate in terms of manufacturing efficiency.

The resin particles A for cores preferably have a weight average particle diameter of 50 nm to 500 nm. For determination of the particle diameters of the resin particle A for cores, resin particle B for shells described below, wax dispersion described below and colorant dispersion, for example, a dynamic light scattering type particle size distribution analyzer (MICROTRAC UPA150, manufactured by Honeywell International Inc.) may be used.

—Shell Layer—

The weight average molecular weight of resin particles B for shells making up the shell layer (MwB) is preferably in the range satisfying the following expression (i) with respect to the weight average molecular weight of resin particles A for cores (MwA).

$$MwA<MwB \quad (i)$$

The weight average molecular weight of resin particles B for shells (MwB) is preferably 10,000 to 100,000. When the MwB is MwA or less, stress resistance sometimes degrades.

The resin particle B for shells are preferably composed of resin component b1 that is softer than the resin particle A for cores and resin component b2 that is harder than the resin particle A for cores. The resin component b1 is more preferably a resin which has a smaller molecular weight (Mwb1) than the resin particle A for cores has (MwA) and has a glass transition temperature of 50° C. to 80° C. The resin component b2 is more preferably a resin which has a larger molecular weight (Mwb2) than the resin particle A for cores has (MwA) and has a glass transition temperature of 50° C. to 80° C. More specifically, the resin component b1 or b2 making up the resin particle B for shells is more preferably a resin satisfying the following expression (ii) for each and having the respective glass transition temperature for each.

$$Mwb1<MwA<Mwb2 \quad (ii)$$

wherein the Mwb1 and Mwb2 represent the weight average molecular weight of the resin component b1 and b2, respectively.

Thus, the MwB of the total resin particle B for shells composed of the resin component b1 and resin component b2 satisfying the expression (ii) is required to satisfy the expression (i).

The resin particles B for shells may be particles containing the resin component b1 and resin component b2 as separate particles, or may be composite particles having in one particle the resin component b1 and resin component b2 as unique layers. The latter configuration is so-called composite resin particles obtained for example by multi-stratifying (complexing) using multistage polymerization method. Specifically each composite particle has resin layers of the resin component b1 and resin component b2 that respectively satisfy their molecular weight ranges. In this case, resin component b2 particles are more preferably coated (encapsulated) by the resin component b1, in terms of uniformity of shell layers and improvement of film forming ability.

Whether the resin particle B for shells has a particle composition containing separate particles each belonging to any one of the resin component b1 and resin component b2, or a composite particle composition, toner particles with smooth surfaces can be obtained by containing the low molecular weight resin component b1 in the resin particle B for shells, which makes the resin particle B for shells excellent in fusion bonding ability and film forming ability onto the core particle surfaces. Furthermore, the resin particle B for shells produces high mechanical strength by containing the resin component b2. By containing a combination of the resin components b1 and b2, it is designed so that the degree of hardness of the total shell layer is increased and loss of interfaces in the shells and smooth surfaces of the toner particles are produced, resulting in remarkably enhanced stress resistance of the toner particles. When the resin component b2 is not contained or the resin component b2 with Mwb2 smaller than MwA is contained, stress resistance degrades and fragmented toner particles are produced. Furthermore when the resin component b1 is not contained or the resin component b1 with Mwb1 larger than MwA is contained, the resin particle B for shells cannot effectively adhere to core particle surfaces, which prevents from forming mechanically strong, uniform shell layers with smooth surfaces, resulting in degradation of stress resistance.

The weight average molecular weight of the resin component b1 (Mwb1) is preferably 5,000 to 30,000, and more preferably 7,000 to 20,000, in terms of effectiveness of fusion-bonding ability and film forming ability of the resin particle B for shells.

The weight average molecular weight of the resin component b2 (Mwb2) is preferably 10,000 to 100,000, and more preferably 30,000 to 100,000, in terms of effective formation of harder shell layers.

The amount of the resin component b1 is preferably 5% by mass to 65% by mass, and more preferably 10% by mass to 40% by mass based on the total amount of the resin particles B for shells. Meanwhile, the amount of the resin component b2 is preferably 35% by mass to 95% by mass, and more preferably 60% by mass to 90% by mass based on the total amount of the resin particles B for shells.

Furthermore, for the resin particle B for shells, functional materials can be used that are different from the resin components b1 and b2 and are effective in chargeability and fixing property of the toner.

The resin particles B for shells are not particularly limited so far as they are resin particles capable of being stably dispersed in an aqueous medium, and for which known resin composition system and production method are applicable. For the resin component b1, styrene-acrylic type copolymer resins or polyester type resins of relatively low molecular weights are appropriately used in terms of fusion bonding and film forming ability of the shell layers. For the resin component b2, styrene-acrylic copolymer resins or polyester resins of relatively high molecular weights are appropriately used in terms of strength of the shell layers. For the resin component b2, as a resin composition system excellent in mechanical strength, a high molecular weight polymers of polyester resin and polyester prepolymers elongated by urethane is appropriately used, which may contain cross-linking structure in order further to increase the strength.

For the resin components b1 and b2 together with the resin particle A for cores, material systems appropriate for the developing system and fixing system may be suitably selected. As specific examples of combinations of the resin particle A for cores, resin component b1 and resin component b2, Pes-StAc-Pes, Pes-Pes-StAc, and Pes-Pes-Pes can be cited, wherein "StAc" represents styrene-acrylic resin, and "Pes" represents polyester resin.

—Mixing Mass Ratio of Resin Particle A for Cores and Resin Particle B for Shells—

The mixing mass ratio (core:shell) of the resin particles A for cores making up the core particles and the resin particles B for shells making up the shell layers is preferably 50:50 to 90:10, and more preferably 60:40 to 80:20. When the amount of resin particles B for shells is too small compared to the amount of resin particles A for cores, the toner mechanical strength by the shell layer is not improved. On the other hand, when the amount of resin particles B for shells is too large relative to the amount of resin particles A for cores, the temperature at which the toner particles are fixed sometimes becomes too high.

The toner according to the present invention contains at least a toner binder, a colorant, and a releasing agent, and contains as required various additives such as a charge control agent and a fluidizer. The amount of the toner binder in the toner, when as the colorant a dye or pigment is used, is preferably 70% by mass to 98% by mass, and more preferably 74% by mass to 96% by mass. The amount of the toner binder in the toner, when as the colorant magnetic powders are used, is preferably 20% by mass to 85% by mass, and more preferably 35% by mass to 65% by mass.

—Colorant—

The colorant is not particularly limited and for which known dyes, pigments and magnetic powders may be used. For example, carbon black, Sudan black SM, First yellow G, Benzidine yellow, Pigment yellow, India first orange, lrgasine red, Baranito aniline red, Toluidine red, Carmine FB, Pigment orange R, Raykired 2 G, Rodamine FB, Rodamine B rake, Methylviolette B rake, Phthalocyanine blue, Pigment blue, Brilliant green, Phthalocyanine green, Oil yellow GG, Kayaset YG, Orasol brown B, Oil pink OP, magnetite, and iron black may be used.

The amount of the colorant in the toner is, when a dye or pigment is used, preferably 2% by mass to 15% by mass. The amount is, when a magnetic powder is used, preferably 15% by mass to 70% by mass, and more preferably 30% by mass to 60% by mass.

The average dispersion particle diameter of a pigment inside the toner particle is preferably 0.05 μm to 0.50 μm, and more preferably 0.10 μm to 0.40 μm. When the average dispersion particle diameter of the pigment is 0.05 μm or more, stable production of the toner becomes possible. When the average dispersion particle diameter of the pigment is 0.50 μm or less, coloring ability of the toner is improved, and in a color toner color reproduction spectrum is improved.

Here, the dispersion diameter is defined as the diameter of the pigment which is the maximum length for the pigment. Specifically, toner particles were embedded in an epoxy resin and sliced as ultrathin sections of about 100 μm thickness, the cross-sectional surface of the toner particle was observed with a transmission electron microscope (TEM) at a magnification of ×10,000 and photographed for 20 toner particles. By evaluating the images of the resultant 20 photographs, the dispersing states of the wax were observed and the dispersion diameters were determined. When the toner particle took an infinite shape, the average value of the maximum diameter and the minimum diameter was taken as a dispersion diameter.

—Releasing Agent—

The releasing agent is not particularly limited, may be suitably selected according to the purpose, and includes, for example, carnauba waxes (C1), Fischer-Tropsh waxes (C2), paraffin waxes (C3), and polyolefin waxes (C4).

The carnauba waxes (C1) include natural carnauba wax, and free-fatty acid-removed carnauba wax.

The Fischer-Tropsh waxes (C2) include petroleum-based Fischer-Tropsh waxes (for example PARAFLINT H1, PARAFLINT H1N4, and PARAFLINT C105 manufactured by SCHUMANN SASOL GmbH & CO. KG.), natural gas-based Fischer-Tropsh waxes (for example FT100 manufactured by Shell MDS), and purified products of these Fischer-Tropsh waxes by such a method as fractionated crystallization (for example MDP-7000 and MDP 7010 manufactured by NIPPON SEIRO CO., LTD.).

The paraffin waxes (C3) include petroleum wax-based paraffin waxes (for example, paraffin wax HNP-5, paraffin wax HNP-9, and paraffin wax HNP-11 manufactured by NIPPON SEIRO CO., LTD.).

The polyolefin waxes (C4) include polyethylene waxes (for example SANWAX 171P and SANWAX LEL400 manufactured by Sanyo Chemical Industries, Ltd.) and polypropylene waxes (for example VISCOL 550P and VISCOL 660P manufactured by Sanyo Chemical Industries, Ltd.).

Among them, carnauba waxes and Fischer-Tropsh waxes are preferable, and carnauba waxes and petroleum-based Fischer-Tropsh waxes are particularly preferable. By using these waxes as releasing agents for toners, the toners with excellent low temperature-fixing property can be obtained.

The amount of the releasing agent in the toner is preferably 0% by mass to 10% by mass, and more preferably 1% by mass to 7% by mass.

The average dispersion particle diameter of the releasing agent inside the toner particles is preferably 0.2 μm to 2.0 μm, and more preferably 0.3 μm to 1.5 μm. When the average dispersion particle diameter of the releasing agents is less than 0.2 μm, the releasing agent becomes easy to exude on the toner surfaces at the time of fixation, and even in a fixing device which does not apply fixing oil, produces sufficient fixing and releasing ability. When the average dispersion particle diameter of the releasing agents is above 2.0 μm, releasing agents having low heat resistance exude on the toner surfaces by stirring the toner particles in a developing device, which tends to cause a phenomenon called filming where toner particles fuse to carrier surfaces and various members in the developing device.

As to the average dispersion diameter of the releasing agents, a wax dispersion diameter is defined as the diameter of the wax which is the maximum length for the wax. Specifically, toner particles were embedded in an epoxy resin and sliced as ultrathin sections of about 100 μm thickness, stained with ruthenium tetroxide, then the cross-sectional surfaces of the toner particles were observed using a transmission electron microscope (TEM) at a magnification of ×10,000 and photographed for 20 toner particles. By evaluating the images of the resultant 20 photographs, the dispersing states of waxes were observed and their dispersion diameters were determined. When the wax took an infinite form, the average value of the maximum diameter and the minimum diameter was taken as a dispersion diameter.

—Charge Control Agent—

The charge control agent is not particularly limited, can be suitably selected depending on the purpose, and includes for example nigrosine dyes, quaternary ammonium salt compounds, quaternary ammonium base-containing polymers, metal-containing azo dyes, salicylic acid metal salts, sulfonic acid group-containing polymers, fluorine-containing polymers (fluorine-modified polymers) and halogen-substituted aromatic ring-containing polymers.

The amount of the charge control agent in the toner is preferably 0% by mass to 5% by mass, and more preferably 0.01% by mass to 4% by mass.

The charge control agent can be, as required, put in a state where the charge control agents are aggregated as the same times as a resin and so forth and are dispersed in the toner, or in another state where they adhere to the toner surfaces.

—External Additive—

An external additive made of fine inorganic particles are preferably attached to surfaces of toner particles, wherein the fine inorganic particles preferably contain fine silica particles having a degree of hydrophobizing of 50% or more and a BET specific surface area of 100 $m^2/g$ to 300 $m^2/g$ and fine titania particles having a degree of hydrophobizing of 50% or more and a BET specific surface area of 20 $m^2/g$ to 150 $m^2/g$.

By combining the silica particles and the titania particles for external addition to the toner as an external additive, properties required for the toner are effectively obtained. Although the silica particles have an advantage of improving flowability of the toner, they have disadvantages of increasing extremely the charge amount of the toner or increasing environmental dependency of the charge amount of the toner. On the other hand, though the titania particles do not improve flowability of the toner, they cause less increase of the charge amount and have less environmental dependency, compared to the silica particles.

By setting the degree of hydrophobizing as 50% or more for both external additives, a hydrophobic property of the toner is improved, and the environmental dependency of the electrostatic property and flowability of the toner can be reduced.

By setting the BET specific surface area as 100 $m^2/g$ or larger for silica particles, decrease of flowability caused by embedding into the toner particles the silica adhered to toner surfaces by stirring in a developing device is suppressed. By setting the BET specific surface area as 300 $m^2/g$ or smaller, sufficient flowability is given to the toner.

By setting the BET specific surface area as 20 $m^2/g$ or larger for titania particles and by embedding into the toner particles the titania particles adhered to the toner surface by stirring in a developing device, changes in the electrostatic property are suppressed. By setting the BET specific surface area as 150 $m^2/g$ or smaller, sufficient flowability is given to the toner.

The BET specific surface area of the fine inorganic particles may be determined according to JIS standard (Z8830 and R1626). Specifically, dried fine inorganic particles are subjected to a gas adsorption method (a method of fluxion) using MULTISORB 12 manufactured by YUASA IONICS COMPANY, LIMITED. As a carrier gas, a mixed gas of nitrogen and helium is used. The BET specific surface area can be calculated from the values of desorption peaks.

The hydrophobizing degree of the fine inorganic particles are measured as follows by a measurement method of hydrophobizing degree using methanol. Fine inorganic particles (0.2 g) are added to 50 ml of water in a conical flask. Fine inorganic particles are titrated with methanol using a buret, while the solution in the conical flask is continuously stirred by a magnetic stirrer. The time point at which sedimentation of the fine inorganic particles ends (end time of sedimentation of the fine inorganic particles) is defined as the time point at which all the fine inorganic particles are suspended in the liquid. The hydrophobizing degree is expressed as a percentage of the methanol volume in the volume of a liquid mixture of methanol and water at the end time of sedimentation of the fine inorganic particles.

As the external additive, fine silica particles having an average primary particle diameter of 60 nm to 150 nm and approximately spherical shapes are preferably used. Such fine silica particles as above act as rollers on the toner surfaces for the toner to move easily, give excellent cleaning ability, and particularly when toners of small particle diameters achieving high image quality are used, the degradation of developing ability and transfer efficiency is improved.

The average primary particle diameter of the fine silica particles is preferably 60 nm to 150 nm, and more preferably 70 nm to 130 nm. When the average primary particle diameter of the fine silica particles is less than 60 nm, fine silica particles are sometimes embedded in concave parts of a toner surface and do not act as rollers for the toner particles as efficiently as when the average primary particle diameter is 60 nm to 150 nm. On the other hand, when the average primary particle diameter is larger than 150 μm, in case when fine silica particles locate between a blade and a photoconductor surface, since some of the fine silica particles have the contacting areas of the same order of magnitude of the contacting areas of toner particles, some toner particles to be cleaned are not swept by the blade, that is, cleaning failure is often caused.

As the shape of the fine silica particle comes close to, in particular, the spherical shape, the fine silica particle acts more efficiently as a roller. Coming close to the spherical shape means that coming close to the circularity of approximate sphere, specifically means that the circularity is 0.95 or more.

The fine silica particles may be hydrophobized by various coupling agents, hexamethyldisilazane, dimethyldichlorosilane, octyltrimethoxysilane, and so forth.

As methods for externally adding and adhering the fine silica particles onto toner surfaces, a method to mechanically mix and adhere the toner base particles and the fine silica particles using a variety of known mixing devices and a method to disperse uniformly in a liquid phase the toner base particles and the fine silica particles using a surfactant, and so forth and to dry them after an attachment treatment, and so forth are used.

—Other Components—

The other components are not particularly limited, can be selected suitably depending on the purpose, and include, for example, a flowability improver, a cleaning ability improver, a magnetic material, and a metal soap.

The flowability improver increases a hydrophobic property by a surface treatment, can prevent degradation of flow characteristics or charging characteristics even at a high humidity, and includes silane coupling agent, a silylating agent, a silane coupling agent having a fluorinated alkyl group, an organic titanate-based coupling agent, an aluminum-based coupling agent, a silicone oil, a modified silicone oil, and so forth.

The cleaning ability improver is added to the toner for removing a residual developer after transfer left on a latent electrostatic image bearing member and an intermediate transfer body, and includes for example, a fatty acid metal salt such as zinc stearate, calcium stearate, stearic acid; fine polymer particles produced by soap free emulsification polymerization such as fine polymethylmethacrylate particles and fine polystyrene particles. The fine polymer particles preferably have relatively narrow particle size distribution and appropriately have a volume average particle diameter of 0.01 μm to 1 μm.

The magnetic material is not particularly limited, can be appropriately selected from known magnetic materials depending on the purpose, and includes, for example, iron powder, magnetite and ferrite. Among these, white magnetic materials are preferable in terms of color tone.

<Method for Producing Toner>

The toner according to the present invention can be produced via the step of aggregating polyester resin particles in an aqueous medium using a dispersion made by emulsifying and dispersing the polyester resin particles in the aqueous medium.

Specifically, the toner can be produced by a method to aggregate polyester resin, a releasing agent and a colorant, or a method in which polyester resin particles containing a releasing agent and polyester resin particles containing a colorant are separately prepared and they are aggregated.

The production method of the toner makes it possible to produce stably toner with small particle diameters and sharp particle size distribution advantageous for producing high quality images. Furthermore the production method also makes it possible to control, as required, reciprocal existing states of the polyester resin, the releasing agent and the colorant, and to bring out the property of the polyester resins effectively.

"To aggregate", as used herein, means a situation where at least a plurality of resin particles simply adhere to one another. By "aggregating", so called heteroaggregation particles (particle groups) are formed, in which composing particles are in contact with one another, however resin particles, and so forth are not fusion-bonded. The particle groups formed by "aggregating" are called, herein, as "aggregated particles."

Specific methods for producing the toner are described below.

—Emulsification Step—

The emulsified liquid is obtained by an emulsification step for emulsifying the polyester resins in an aqueous medium containing a basic substance. The emulsified particles (liquid drops) of the polyester resins described above are formed, in the emulsification step, by giving shearing force to the mixture solution of an aqueous medium and a liquid containing the polyester resins (polymer liquid).

The emulsified particles (liquid drops) of the polyester resins are preferably formed, in the emulsification step, by preparing a polymer (mixture) liquid through adding a colorant to the polymer liquid containing the polyester resins and by giving shearing force to the mixture solution of the aqueous medium and the polymer (mixture) liquid. In this way the emulsified liquid in which the colorant is dispersed can be prepared and used preferably for toner production.

At this moment, emulsified particles can also be formed by decreasing viscosity of the polymer liquid through heating or dissolving the polyester resins in an organic solvent. Alternatively also a dispersing agent may be used for stabilization of the emulsified particles and thickening of the aqueous medium. On some occasions below, the dispersion containing such emulsified particles is called as a "dispersion of resin particles".

The dispersing agent is not particularly limited, can be selected suitably depending on the purpose, and includes, for example, water-soluble polymers such as polyvinyl alcohol, methylcellulose, ethylcellulose, hydroxyethyl cellulose, carboxymethyl cellulose, sodium polyacrylate, and sodium polymethacrylate; anionic surfactants such as sodium dodecylbenzenesulfonate, sodium octadecylsulfate, sodium oleate, sodium laurate, and potassium stearate; cationic surfactants such as laurylamine acetate, stearylamine acetate, and lauryltrimethylammonium chloride; zwitterionic surfactants such as lauryldimethylamineoxide; surfactants including non-ionic surfactants, such as polyoxyethylene alkyl ether, polyoxyethylene alkylphenyl ether, and polyoxyethylene alkylamine; and inorganic compounds such as tricalcium phosphate, aluminum hydroxide, calcium sulfate, calcium carbonate, and barium carbonate.

When inorganic compounds are used as the dispersing agents, commercially available inorganic compounds may be directly used, or in order to obtain fine particles fine particles of inorganic compounds may be formed in the dispersing agent.

The amount of the dispersing agent used is preferably 0.01 parts by mass to 20 parts by mass per 100 parts by mass of the polyester resins (toner binder).

If a dicarboxylic acid having a sulfonate group is copolymerized in the polyester resin (preferably if an appropriate amount of components derived from the dicarboxylic acids having a sulfonate group is contained in the components derived from acids) in the emulsification step, the amount of the dispersion stabilizer such as a surfactant can be reduced. When the amount of the sulfonate group in the polyester resin is made larger, the emulsification becomes easier to perform, however, on some occasions electrostatic property, especially electrostatic property at high temperature, high-humidity conditions degrades. Thus it is preferable to design to use as small amount of sulfonate group as possible for compositions. Alternatively there are also compositions capable of forming emulsified particles without using a sulfonate group.

The organic solvent is not particularly limited, can be selected suitably depending on the purpose, and includes for example ethyl acetate and toluene.

The amount of the organic solvent used is preferably 50 parts by mass to 5,000 parts by mass, and more preferably 120 parts by mass to 1,000 parts by mass, per 100 parts by mass of the total amount of the polyester resins and other monomer used as required (on some occasions below they are referred to simply as "polymer").

When a colorant is used, the colorant may be mixed to the polyester resins before the emulsified particles are formed.

Usually when the polyester resin is emulsified directly, the pH of the emulsion becomes 3 to 4, and this too acidic pH makes the polyester resin to hydrolyze. However by adding a basic substance, pH of the pre-emulsified liquid at the time of emulsification is made neutral, which makes it possible to emulsify the polyester resins without causing hydrolysis and to obtain an emulsified liquid. The pH at the time of preparation of the emulsified liquid is preferably 4.5 to 9.5, and more preferably 5 to 9, and still more preferably 6 to 8, in terms of prevention of hydrolysis of the polyester resins.

The basic substance includes, for example, inorganic bases such as ammonia, sodium hydroxide, potassium hydroxide, sodium carbonate, potassium carbonate, sodium hydrogencarbonate, and potassium hydrogencarbonate; organic bases such as diethylamine and triethylamine. Among them inorganic bases are preferable and ammonia is particularly preferable.

Emulsion machines used in the emulsification step include, for example, homogenizers, homomixers, clear mixes, pressure kneaders, extruders, and media dispersion machines.

The emulsified particles (liquid drops) of the crystalline polyester resins preferably have the average particle diameter (volume average particle diameter) of 0.01 μm to 1 μm, and more preferably have 0.03 μm to 0.8 μm, and still more preferably have 0.03 μm to 0.4 μm.

The dispersing method of the colorant is not particularly limited, for which any methods may be applied. For example, for the dispersing method, general dispersing methods such as rotational shearing type homogenizers, and ball mills having medias, sand mills, dyno-mills and rotor-stator type emulsion machines may be used.

As required, aqueous dispersion of these colorants using a surfactant and dispersion in an organic solvent of these colorants using a dispersing agent may be prepared. On some occasions below, such dispersion of the colorant is referred to as "dispersion of the colorant particles". For the surfactants and dispersing agents used in the dispersion, dispersing agents similar to those which may be used at the time of dispersion of the polyester resins may be used.

—Aggregation Step—

At the aggregation step, aggregates of emulsified particles are formed by heating and aggregating the emulsified particles thus obtained at a temperature near the melting point of the polyester resin but not greater than that melting point.

The aggregates of the emulsified particles are formed by adjusting the pH of the emulsified liquid to acidic while the emulsified liquid is stirred. The pH of the emulsified liquid for forming the aggregates is preferably 2 to 6, and more preferably 2.5 to 5, and still more preferably 2.5 to 4. At this time a flocculent may be effectively used.

For the flocculent, in addition to surfactants which have reverse polarity to the surfactants used for the dispersing agents and inorganic metal salts, divalent or more metal complexes can be suitably used. The metal complexes are particularly preferable because they can reduce the amount of surfactant used and can improve charging characteristics.

The inorganic metal salts are not particularly limited, can be selected suitably depending on the purpose, and include, for example, metal salts such as calcium chloride, calcium nitrate, barium chloride, magnesium chloride, zinc chloride, aluminum chloride, and aluminum sulfate; inorganic metal salt polymers such as polyaluminum chloride, polyaluminum hydroxide, and calcium polysulfide. Among these, aluminum salts or polymers thereof are particularly preferable. In order to obtain sharper particle size distributions, for the valence of inorganic metal salt, divalence is preferred to monovalence, trivalence is preferred to divalence, and tetravalence is preferred to trivalence, for the type of the inorganic metal salt when the valence is the same, the polymer type, that is the inorganic metal salt polymer, is preferred to the monomer type.

—Unification Step—

At the unification step, progress of aggregation is stopped by adjusting pH of the suspension of the aggregates into the range of 3 to 10, while the suspension is stirred in the same way as the aggregation step, and the aggregates are each unified by heating at a temperature of the melting point of the polyester resins or higher. The temperature at which the aggregates are heated is a temperature of the melting point of the polyester resins or higher. The heating time is a time after which the unification is sufficiently confirmed, and may be about 0.5 hr to 10 hr.

From the particles obtained after the unification step, toner particles are produced through a solid-liquid separation step such as filtration, through a washing step as required, and through a drying step. In this case, it is preferable to wash sufficiently at the washing step, in order to secure sufficient charging characteristics and reliability as a toner. At the drying step, any drying methods, such as a vibration type fluidized drying method, a spray-drying method, a freeze-drying method, and a flash jet method can be adopted. The water content of the toner after the drying step is preferably adjusted to 1.0% or less, and more preferably adjusted to 0.5% or less.

The weight average particle diameter ($D_4$) of the toner is preferably 3.0 μm to 7.0 μm, and more preferably 3.5 μm to 6.5 μm. The ratio of the weight average particle diameter ($D_4$) and number average particle diameter (Dn) ($D_4$/Dn) is preferably 1.05 to 1.30, and more preferably 1.10 to 1.20.

When the weight average particle diameter ($D_4$) is 3.0 μm or more, cleaning ability of the residual toner particles left on the surface of the latent electrostatic image bearing member becomes excellent, and when the weight average particle diameter is 7.0 μm or less, dot reproducibility and granularity of the print images and fixing property become excellent. When the ratio $D_4$/Dn is 1.05 or more, stable toner production becomes possible, and when the ratio is 1.30 or less, dot reproducibility and granularity of the print images become excellent at the same time that occurrence of abnormal images such as background fogging of images can be prevented.

Here, as a measurement device for toner particle size distribution, Coulter Multisizer II (manufactured by Coulter Company Limited) is used. A measurement method is described below.

First, to 100 ml to 150 ml of an aqueous electrolyte solution, 0.1 ml to 5 ml of a surfactant (preferably an alkylbenzene sulfonate salt) is added as a dispersing agent. Where the electrolyte solution is an aqueous solution of 1% by mass NaCl using first-grade sodium chloride, and may be for example Isoton-II (manufactured by Coulter Company Limited). The sample for measurement (2 mg to 20 mg) is further added. The electrolyte solution in which the sample is suspended is subjected to dispersion treatment for about 1 min to 3 min by an ultrasonic dispersion device. Volumes and numbers of toner particles are determined by the measurement device using a 100 μm aperture as an aperture, and volume distribution and number distribution are calculated. From the distributions thus produced, the weight average particle diameter ($D_4$) and the number average particle diameter (Dn) of the toner can be obtained.

—Average Circularity—

The average circularity of the toner is preferably 0.93 to 0.99, and more preferably 0.94 to 0.98. When the average circularity is 0.93 or higher, transfer efficiency in primary transfer from the latent electrostatic image bearing member to a sheet of transfer paper or to the intermediate transfer member or in secondary transfer from the intermediate transfer member to a sheet of transfer paper becomes excellent. When the average circularity is 0.99 or lower, cleaning ability or removability of the residual toner particles remained on the surface of the latent electrostatic image bearing member becomes excellent.

The average circularity of the toner may be determined as follows.

Ultrafine powder toner is injected into a flow type particle image analyzer ("FPIA-2100" manufactured by SYSMEX Corp.) for analysis by analysis software (FPIA-2100 Data Processing Program for FPIA version 00-10). Specifically into a 100 ml glass beaker, 0.1 ml to 0.5 ml of a 10% by mass surfactant (an alkylbenzene sulfonate salt, NEOGEN SC-A; manufactured by Dai-ichi Kogyo Seiyaku Co., Ltd.) was added, 0.1 g to 0.5 g of each toner was added and agitated by a micro spatula, and then to the resultant mixture 80 ml of ion-exchange water was added. The dispersion thus obtained was subjected to 3-min dispersion treatment using an ultrasonic dispersing device (manufactured by HONDA ELECTRONICS CO., LTD). The dispersion concentration was made 5,000 particles/μl to 15,000 particles/μl, and the shape and the distribution of the toners are determined using the FPIA-2100. It is important in this measurement method to adjust the dispersion concentration in the range of 5,000 particles/μl to 15,000 particles/μl for measurement in terms of measurement reproducibility of the average circularity. It is necessary to alter the conditions of the dispersion, that is, the amount of the surfactant added and the amount of the toner, in order to obtain the dispersion concentrations in that range. As with measurement of toner particle diameters as described above, the required amount of the surfactant depends on hydrophobicity of the toner. When an excess amount of the surfactant is added, noises due to bubbles are caused, and when an insufficient amount of the surfactant is used, the toner particles fail to be wetted sufficiently, resulting in insufficient dispersion. The amount of the toner to be added depends on the particle diameters of toner, is required to be small when the particle diameters are small, and is required to be large when the particle diameters are large. When the toner particle diameters are 3 μm to 7 μm, a dispersion concentration in the range of 5,000 particles/μl to 15,000 particles/μl can be obtained by adjusting the toner amount to be added to 0.1 g to 0.5 g.

<Developer>

The developer used in the present invention contains at least the toner according to the present invention and the other components which are appropriately selected such as a carrier. The developer may be a one-component developer or a two-component developer, however when it is used in a high-speed printer, and so forth adapted to enhanced information processing speed developed in recent years, it is preferably the two-component developer in terms of improvement of operating lives, and so forth.

When the one-component developer using the toner described above is used, even after expending and supplying the toner are performed, the variation of the toner particle diameters is small, filming of the toner to a developing roller as a developer bearing member and fusion-bonding of the toner to a layer-thickness control member for thinning the toner layer such as a blade, and so forth are not caused, and also even in case of a developing unit being used (having its content being stirred) for long time, excellent and stable developing ability and images are obtained. When the two-component developer using the toner described above is used, even after expending and supplying the toner are performed for long time, the variation of the particle diameters of the toner in the developer is small, and also even in case of stirring for long time in a developing unit, excellent and stable developing ability is obtained.

—Carrier—

The carrier is not particularly limited, can be selected suitably depending on the purpose, and is preferably a carrier particle having a core material and a resin layer coating the core material.

The core material is not particularly limited, can be selected suitably from the known core materials, is preferably, for example, manganese-strontium (Mn—Sr) materials and manganese-magnesium (Mn—Mg) materials of 50 emu/g to 90 emu/g, and also highly magnetized materials such as iron powder (100 emu/g or more) and magnetite (75 emu/g to 120 emu/g) in terms of ensuring appropriate image density. Weak magnetizable materials such as copper-zinc (Cu—Zn) materials (30 emu/g to 80 emu/g) are also preferable, because they can reduce the shock to the latent electrostatic image bearing member on which the toner particles stands in the form of chains and they are advantageous for high image quality. These may be used alone or in combination.

The average particle diameter (volume average particle diameter ($D_{50}$)) of the core material is preferably 10 μm to 200 μm, and more preferably 40 μm to 100 μm. When the average particle diameter (volume average particle diameter ($D_{50}$)) is less than 10 μm, fine powders become dominated in the carrier particle distribution, reducing magnetization per particle and causing the carrier particles to fly on some occasions. When the average particle diameter is more than 200 μm, the specific surface area is reduced to cause the carrier particles to fly on some occasions, and in full color images having large solid parts, reproducibility of especially the solid parts degrades on some occasions.

The material for the resin layer is not particularly limited, can be selected suitably from the known resins depending on the purpose, and includes for example, amino resins, polyvinyl resins, polystyrene resins, halogenated olefin resins, polyester resins, polycarbonate resins, polyethylene resins, polyvinyl fluoride resins, polyvinylidene fluoride resins, polytrifluouroethylene resins, polyhexafluoropropylene resins, copolymers of vinylidene fluouride and an acrylic monomer, copolymers of vinylidene fluoride and vinyl fluoride, fluoroterpolymers (copolymers composed of three types of monomer including a type of fluorinated monomer) such as terpolymer of tetrafluoroethylene, vinylidene fluoride and non-fluoride monomer, and silicone resins. These may be used alone or in combination of two or more. Among them, silicone resins are particularly preferable.

The silicone resin is not particularly limited, can be selected suitably from the generally known silicone resins depending on the purpose, and includes, for example, straight silicone resins having only organosiloxane bonds; and silicone resins modified with alkyd resins, polyester resins, epoxy resins, acrylic resins, or urethane resins.

For the silicone resin, commercially available products can be used, and the commercially available products of the straight silicone resin include, for example, KR271, KR255, and KR152 manufactured by Shin-Etsu Chemical Co., Ltd.; and SR2400, SR2406, and SR2410 manufactured by Dow Corning Toray Silicone Co., Ltd.

For the modified silicone resin, commercially available products can be used, and, for example, KR206 (modified with alkyd), KR5208 (modified with acryl), ES1001N (modified with epoxy) and KR305 (modified with urethane) manufactured by Shin-Etsu Chemical Co., Ltd.; and SR2115 (modified with epoxy) and SR2110 (modified with alkyd) manufactured by Dow Corning Toray Silicone Co., Ltd are used.

The silicone resin may also be used alone, or may be used in combination with a crosslinking component, charge amount regulating component, and so forth.

The resin layer may contain a conductive powder as required, and the conductive powder includes, for example, metal powder, carbon black, titanium oxide, tin oxide and zinc oxide. The average particle diameters of these conductive powders are preferably 1 μm or less. When the average particle diameter is above 1 μm, electric resistance becomes difficult to control on some occasions.

The resin layer can be formed, for example, by dissolving the silicone resin or the like in a solvent to prepare a coating solution, and coating uniformly the surfaces of the core materials with the coating solution according to the known coating method, followed by dying and subsequent baking. The coating method includes, for example, dipping, spraying, and brush coating.

The solvent is not particularly limited, can be selected suitably depending on the purpose, and includes, for example, toluene, xylene, methyl ethyl ketone, methyl isobutyl ketone, cellsolve and butyl acetate.

The baking process is not particularly limited, may be a process using an external heating process or an internal heating process, and includes, for example, a process using a fixed type electric furnace, a flow type electric furnace, a rotary electric furnace or a burner furnace, and a process using microwave.

The amount of the resin layer in the carrier is preferably 0.01% by mass to 5.0% by mass. When the amount is less than 0.01% by mass, a uniform resin layer can not be formed on the surface of the core material on some occasions. When the amount is above 5.0% by mass, uniform carrier particles are not obtained on some occasions, because the resin layer becomes too thick to avoid granulation among the carrier particles.

When the developer is a two-component developer, the amount of carrier in the two-component developer is not particularly limited, can be selected suitably depending on the purpose, and, for example, preferably 90% by mass to 98% by mass, and more preferably 93% by mass to 97% by mass.

The mixing ratio of toner and carrier in the two-component developer is preferably generally 1 part by mass to 10.0 parts by mass of the toner per 100 parts by mass of the carrier.

<Toner Container>

The toner container used in the present invention contains therein the toner or the developer according to the present invention.

The toner container is not particularly limited, can be selected suitably from the known containers, and include suitably, for example, the container having a main body of the toner container and a cap.

The size, shape, structure, and material of the main body of the toner container are not particularly limited, can be selected suitably depending on the purpose. For example the shape is preferably a cylindrical shape, and particularly preferably a shape in which spiral irregularity is formed on the internal circumference, the toner as the content can be moved towards the side of a discharge port by rotating the container, and a portion or all of the spiral section has a bellows function.

The material for the main body of the toner container is not particularly limited, is preferably excellent in dimensional accuracy, and includes appropriately, for example, a resin. Among them, the examples include appropriately polyester resins, polyethylene resins, polypropylene resins, polystyrene resins, polyvinyl chloride resins, polyacrylic acid, polycarbonate resins, ABS resins and polyacetal resins.

The toner container is easily stored and transported, is excellent in handling ability, and can be appropriately used for supplying toner by being detachably mounted on a process cartridge, an image forming apparatus, and so forth described later.

(Process Cartridge)

The process cartridge according to the present invention includes at least a latent electrostatic image bearing member for bearing latent electrostatic images and a developing unit for developing the latent electrostatic images born on the latent electrostatic image bearing member with toner and forming visible images, and further includes other units suitably selected as required.

The developing unit contains at least a developer container for containing the toner or the developer of the present invention and a developer bearing member for bearing and conveying the toner or the developer contained in the developer container, and may further contain a layer-thickness control member for controlling the thickness of toner layer born by the developer bearing member.

The process cartridge may be detachably mounted on image forming apparatuses of various electrophotographic methods, is preferably detachably mounted on an image forming apparatus according to the present invention described later.

The process cartridge, for example as shown in FIG. 1, houses a latent electrostatic image bearing member 101, contains a charging unit 102, a developing unit 104, a transferring unit 108, and a cleaning unit 107, and further contains other units as required. In FIG. 1, 103 indicates exposure light by an exposing unit, and 105 indicates a recording medium.

The following is a description of the image forming process by the process cartridge shown in FIG. 1. The latent electrostatic image bearing member 101 rotates in the direction as indicated by the arrow, the surface of the latent electrostatic image bearing member is charged by the charging unit 102 and exposed to exposure light 103 by the exposing unit (not shown), which results in the formation of a latent electrostatic image corresponding to the exposure image. The latent electrostatic image is developed by the developing unit 104 to form a visible image, which is then transferred to the recording medium 105 by the transferring unit 108 and a printout is thus produced. Then, the surface of the latent electrostatic image bearing member after image transfer is cleaned by the cleaning unit 107, and further discharged by a charge eliminating unit (not shown) to prepare for the next cycle of the operations described above.

(Image Forming Method and Image Forming Apparatus)

The image forming method according to the present invention contains at least a latent electrostatic image forming step, a developing step, a transferring step, a fixing step and a cleaning step, and further contains other steps suitably selected as required, such as a charge eliminating step, a recycling step and a controlling step.

The image forming apparatus according to the present invention contains at least a latent electrostatic image bearing member, a latent electrostatic image forming unit, a developing unit, a transferring unit, a fixing unit and a cleaning unit, and further contains other units suitably selected as required, such as a charge eliminating unit, a recycling unit and a control unit.

The latent electrostatic image forming step is a step for forming a latent electrostatic image on the latent electrostatic image bearing member.

The material, shape, structure, size, and so forth of the latent electrostatic image bearing member (sometimes referred to as "electrophotographic photoconductor", "photoconductor", or "image bearing member" below) are not particularly limited, and can be selected suitably from known ones. The shape of the latent electrostatic image bearing member is preferably a drum shape, and the material of the photoconductor includes, for example, inorganic materials such as amorphous silicon and selenium, and organic materials such as polysilane and phthalopolymethine, and so forth. Among them, amorphous silicon is preferable in terms of long operating lives.

A latent electrostatic image can be formed, for example, by charging uniformly the surface of the latent electrostatic image bearing member, and then by exposing it imagewise, by means of the latent electrostatic image forming unit. The latent electrostatic image forming unit is, for example, equipped with at least a charging device for charging uniformly the surface of the latent electrostatic image bearing member and an exposing device for exposing imagewise the surface of the latent electrostatic image bearing member.

The surface of the latent electrostatic image bearing member can be charged, for example, by applying a voltage thereon by means of the charging device.

The charging device is not particularly limited, can be selected suitably depending on the purpose, and includes, for example, known contact charging device equipped with conductive or semi-conductive roller, brush, film or rubber blade and non-contact charging device using corona discharge such as corotron and scorotron.

The exposure can be performed, for example, by exposing the surface of the latent electrostatic image bearing member imagewise by means of the exposing device.

The exposing device is not particularly limited so far as it can expose imagewise the surface of the latent electrostatic image bearing member charged by the charging device, can be selected suitably depending on the purpose, and includes, for example, copy optical systems, rod lens array systems, laser optical systems and liquid crystal shutter optical systems.

In the present invention, the back-exposure method may be adopted in which the latent electrostatic image bearing member is exposed imagewise from the back side.

—Developing Step and Developing Unit—

The developing step is a step for forming visible images by developing the latent electrostatic images using the toner or the developer according to the present invention.

The visible images can be formed, for example, by developing the latent electrostatic images using the toner or developer according to the present invention, by means of the developing unit.

The developing unit is not particularly limited so far as it can develop using the toner or the developer according to the present invention, can be selected suitably from the known ones, and includes, for example, preferably the developing units having at least a developing device which houses the toner or developer of the present invention and can provide the toner or the developer to the latent electrostatic images in a contact or non-contact manner, more preferably a developing device equipped with the toner container.

The developing device may be according to a dry developing method or a wet developing method, and may be a monochrome developing device or multicolor developing device. It includes preferably a developing device having a stirrer for agitating with production of friction the toner or the developer to charge them and having a rotatable magnet roller.

In the developing device, for example, the toner and carrier are mixed and stirred, the toner are charged by the friction at this time, and held on the surface of the rotating magnet roller in the form of chains to form a magnetic brush. Since the magnet roller is arranged in the vicinity of the latent electrostatic image bearing member (photoconductor), some toner particles composing the magnetic brush formed on the surface of the magnet roller moves to the surface of the latent electrostatic image bearing member (photoconductor) by an electrical attraction force. As a result, the latent electrostatic images are developed with the toner and visible images are formed on the surface of the latent electrostatic image bearing member (photoconductor) with the toner.

The developer contained in the developing device is a developer containing the toner according to the present invention, and may be a one-component developer or a two-component developer. A toner contained in the developer is the toner according to the present invention.

—Transferring Step and Transferring Unit—

The transferring step is a step for transferring the visible images onto a recording medium, is preferably an aspect of transferring step in which on an intermediate transfer member the visible images are primarily transferred, the visible images on the intermediate transfer member are secondarily transferred onto the recording material, and more preferably another aspect of transferring step in which toners of two or more colors, preferably full-color toners are used as the toner, and a primary transfer step for transferring visible images onto an intermediate transfer member to form complex-transferred images, and a secondary transfer step for transferring the complex-transferred images onto a recording medium are included.

The transferring can be performed by charging the visible images on the latent electrostatic image bearing member (photoconductor) using a transfer-charging device, by means of the transferring unit. The transferring unit is preferably an aspect of transferring unit having a primary transfer unit for transferring visible images onto an intermediate transfer member to form complex-transferred images and having a secondary transfer unit for transferring the complex-transferred images onto a recording medium.

The intermediate transfer member is not particularly limited, can be selected suitably from the known transfer members depending on the purpose, and includes, for example, favorably a transfer belt.

The transferring unit (the primary transfer unit and the secondary transfer unit) preferably contains at least a transferring device for peeling the visible images formed on the latent electrostatic image bearing member (photoconductor) and charging them on the side of the recording medium. The transferring units may be provided as a single unit or as two or more units.

The transferring device includes corona transferring devices using corona discharge, transfer belts, transfer rollers, pressure transfer rollers and adhesive transferring devices.

The recording medium is not particularly limited and can be selected suitably from the known recording mediums (recording papers).

The fixing step is a step for fixing the visible images transferred on the recording medium using a fixing unit, and may be performed for each color toner to be transferred on the recording medium or simultaneously after all colors are laminated.

The fixing device is not particularly limited, can be selected suitably depending on the purpose, and known heating and pressing units are appropriate. The heating and pressing unit includes combinations of heating rollers and pressing rollers, combinations of heating rollers, pressing rollers, and endless belts, and sheets.

The heating temperature of the heating and pressing unit is preferably 80° C. to 200° C.

Using belts or sheets for the toner fixing member makes it possible to provide sufficient fixing property of toners.

In the present invention, depending on the purpose, for example, known optical fixing units may be used along with or in place of the fixing step or the fixing unit.

The charge eliminating step is a step for charge elimination by applying a charge-eliminating bias to the latent electrostatic image bearing member, and is performed suitably by means of the charge eliminating unit.

The charge eliminating unit is not particularly limited so far as it can apply a discharge bias to the latent electrostatic image bearing member, can be selected suitably from known charge eliminating devices, and includes, for example, suitably charge eliminating lamps and so forth.

The cleaning step is a step for removing the residual toner particles remaining on the latent electrostatic image bearing member, and can be performed suitably by the cleaning unit.

The cleaning unit is not particularly limited so far as it can remove the residual toner particles remaining on the latent electrostatic image bearing member, can be selected suitably from known cleaners, and includes, for example, magnetic brush cleaners, electrostatic brush cleaners, magnetic roller cleaners, cleaning blades, brush cleaners, and web cleaners. Among them, cleaning blades are particularly preferable because of their high toner removing ability, small sizes and cheapness.

Examples of the material for a rubber blade used in the cleaning blade include urethane rubber, silicone rubber, fluororubber, chloroprene rubber and butadiene rubber, among which urethane rubber is particularly preferable.

Using an elastic blade for the cleaning unit makes sure cleaning of the toner particles possible.

The recycling step is a step for recycling the toner particles removed in the cleaning step for use in the developing unit, and can be performed suitably by means of the recycling unit.

The recycling unit is not particularly limited, and includes known conveying units and so forth.

The controlling step is a step for controlling each of the steps described above, can be performed suitably by means of the controlling unit.

The controlling unit is not particularly limited so far as it can control the operations of each unit, can be selected suitably depending on the purpose, and includes, for example, such instruments as sequencers and computers.

Figure 2:
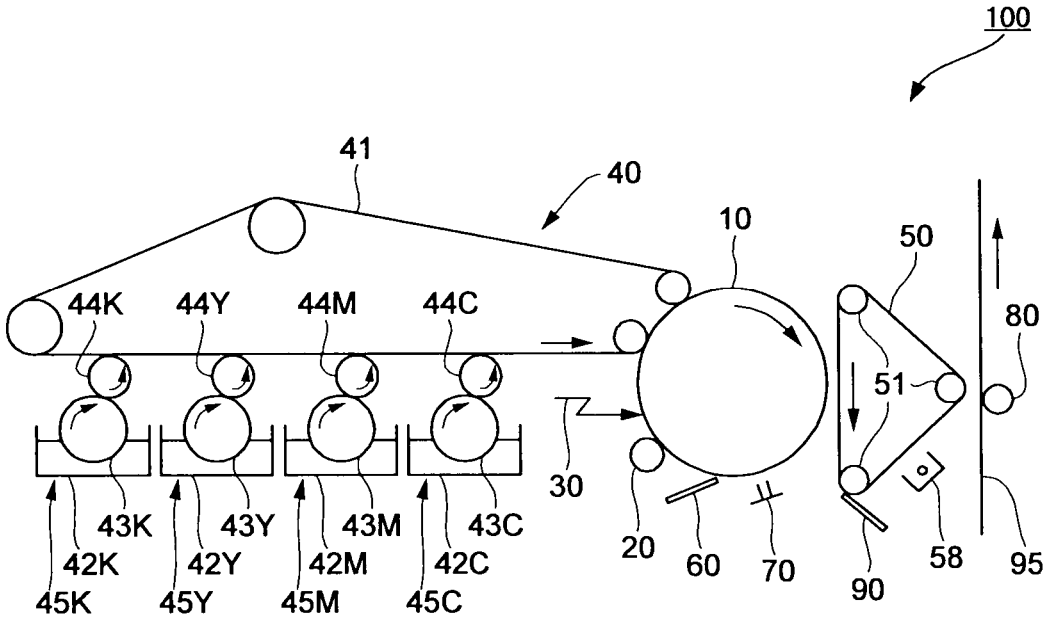
FIG. 2 is a schematic illustration showing an example of an image forming apparatus of the present invention performing an image forming method of the present invention.

An aspect of the image forming method according to the present invention using the image forming apparatus will be described with reference to FIG. 2. In FIG. 2 an image forming apparatus 100 is equipped with a photoconductor drum 10 as the latent electrostatic image bearing member, a charging roller 20 as the charging unit, an exposing device 30 as the exposing unit, a developing device 40 as the developing unit, an intermediate transfer member 50, a cleaning device 60 as the cleaning unit having a cleaning blade, and a charge eliminating lamp 70 as the charge eliminating unit.

The intermediate transfer member 50 is an endless belt, stretched by three rollers 51 arranged inside the belt, and the three rollers are designed to be able to move the belt in the direction indicated by the arrow. A part of the three rollers 51 function as a transfer bias roller capable of applying a given transfer bias (primary transfer bias) to the intermediate transfer member 50. In the vicinity of the intermediate transfer member 50, arranged are a cleaning blade 90 for intermediate transfer member and a transfer roller 80 facing from outside the belt to the intermediate transfer member as the transferring unit capable of applying a transfer bias for transferring (secondarily transferring) the visible images (toner images) onto the recording medium 95. In the area surrounding the intermediate transfer member 50, a corona charging device 58 for charging the visible images on the intermediate transfer member 50 is arranged between the contact part of the latent electrostatic image bearing member 10 and the intermediate transfer member 50 and the contact part of the intermediate transfer member 50 and the recording medium 95, in the rotational direction of the intermediate transfer member 50.

The developing device 40 is composed of a developing belt 41 as a developer bearing member, and a black developing unit 45K, a yellow developing unit 45Y, a magenta developing unit 45M, and a cyan developing unit 45C placed in combination in the surrounding area of the developing belt 41. The black developing unit 45K is equipped with a developer container 42K, a developer supplying roller 43K, and a developing roller 44K. The yellow developing unit 45Y is equipped with a developer container 42 Y, a developer supplying roller 43Y, and a developing roller 44Y. The magenta developing unit 45M is equipped with a developer container 42M, a developer supplying roller 43M, and a developing roller 44M. The cyan developing unit 45C is equipped with a developer container 42C, a developer supplying roller 43C, and a developing roller 44C. The developing belt 41 is an endless belt, stretched by a plurality of belt rollers to be able to rotate and a part of which is in contact with the latent electrostatic image bearing member 10.

In the image forming apparatus 100 shown in FIG. 2, the charging roller 20 charges uniformly the photoconductor drum 10. The exposing device 30 exposes imagewise the photoconductor drum 10 to form latent electrostatic images. The latent electrostatic images formed on the photoconductor drum 10 are developed with a toner supply from the developing device 40 to form visible images (toner images). The visible images (toner images) are transferred (primarily transferred) onto the intermediate transfer member 50 by a voltage applied by a roller 51, and further transferred (secondarily transferred) onto the recording paper 95. As a result, transferred images are formed on the recording paper 95. The residual toner particles on the photoconductor 10 are removed by the cleaning device 60, and charging of the photoconductor 10 is discharged once by the charge eliminating lamp 70.

Figure 3:
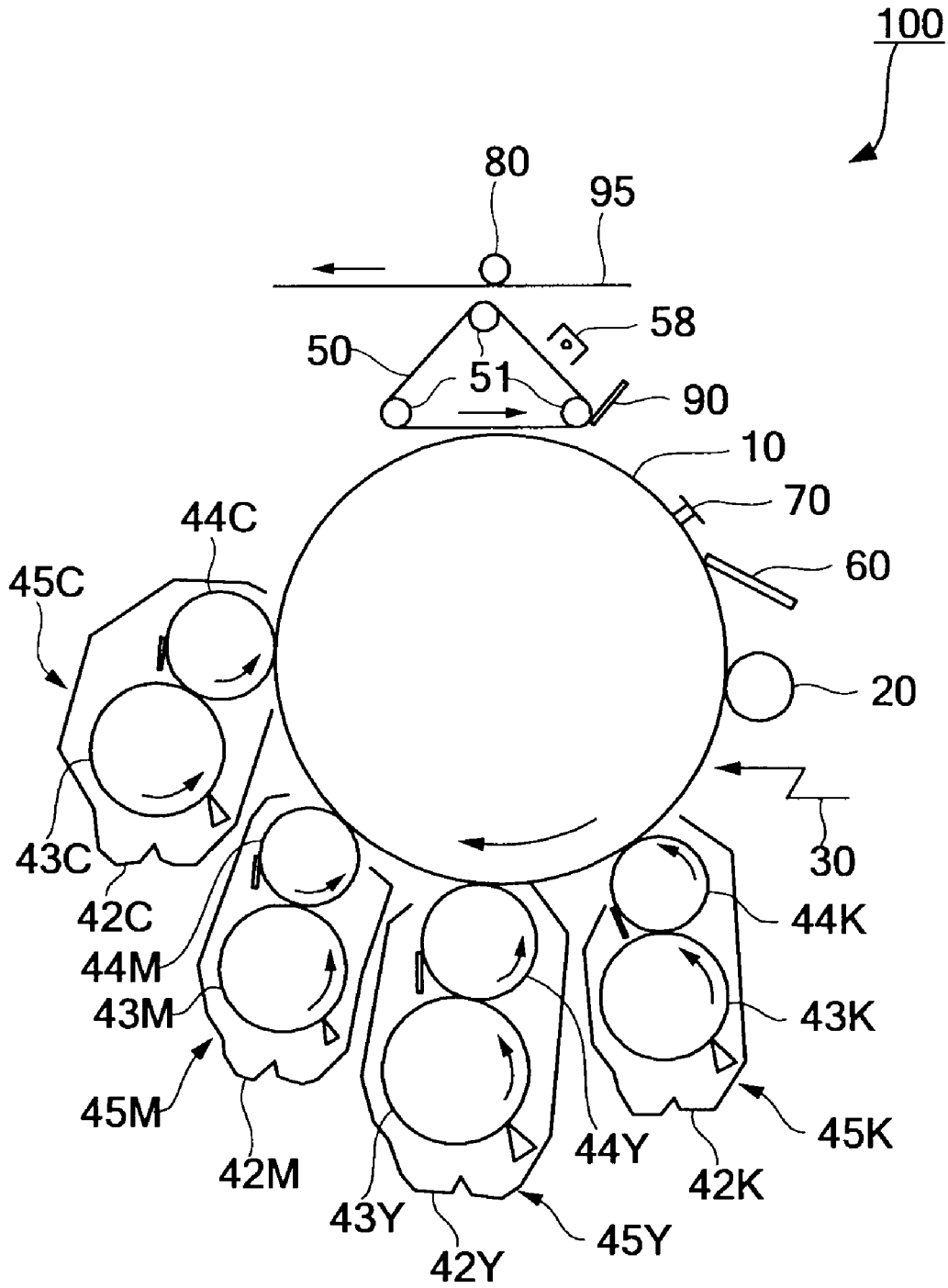
FIG. 3 is a schematic illustration showing another example of an image forming apparatus of the present invention performing an image forming method of the present invention.

Another aspect of the image forming method according to the present invention using an image forming apparatus will be described with reference to FIG. 3. The image forming apparatus 100 shown in FIG. 3 has the same composition and working effect as the image forming apparatus 100 shown in FIG. 2 except that the image forming apparatus of FIG. 3 is without the developing belt 41 and has a black developing unit 45K, a yellow developing unit 45Y, a magenta developing unit 45M, and a cyan developing unit 45C configured around and directly facing to the photoconductor 10. The same numbers as in FIG. 2 are used for the components in FIG. 3 which correspond to those in FIG. 2.

Figure 4:
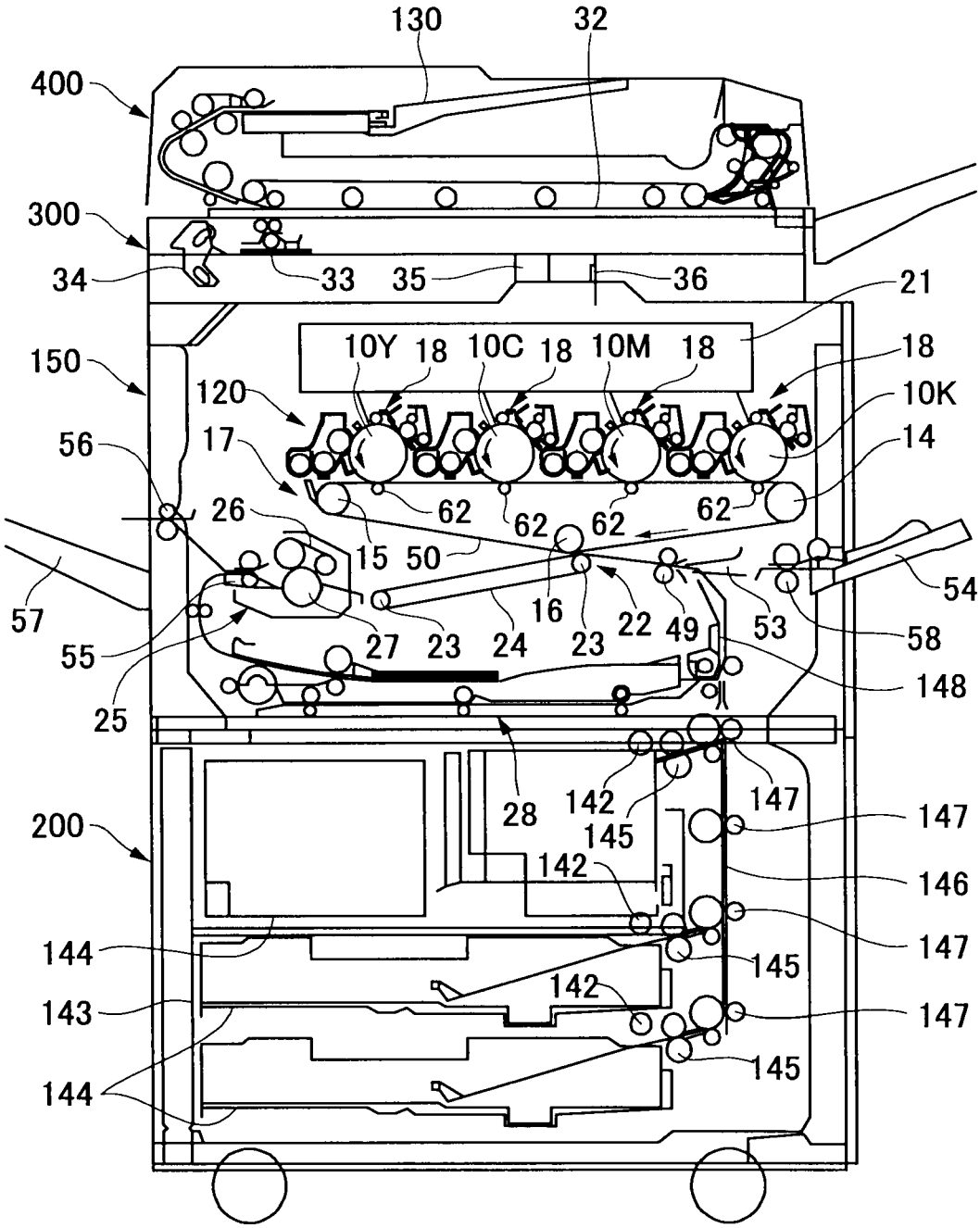
FIG. 4 is a schematic illustration showing an example of an image forming apparatus of the present invention (tandem type color image forming apparatus) performing an image forming method of the present invention.

Still another aspect of the image forming method according to the present invention using the image forming apparatus will be described with reference to FIG. 4. A tandem image-forming apparatus shown in FIG. 4 is a tandem-type color image forming apparatus. The tandem image forming apparatus is equipped with a main body 150 of a copying machine, a paper feeder table 200, a scanner 300, and an automated document feeder (ADF) 400.

At the central part in the main body 150 of the copying machine, an intermediate transfer member 50 of an endless belt shape is placed. The intermediate transfer member 50 is stretched by supporting rollers 14, 15 and 16, and is capable of rotating clockwise in FIG. 4. Near the supporting roller 15, a cleaning device 17 for intermediate transfer member for removing the residual toner particles remained on the intermediate transfer member 50 is placed. Above the intermediate transfer member 50 stretched by the supporting rollers 14 and 15, placed is a tandem-type developing device 120, in which 4 image forming units 18 of yellow, cyan, magenta, and black are placed in parallel in the direction of conveying direction of the intermediate transfer member and facing it. In the vicinity of the tandem-type developing device 120, an exposing device 21 is placed. A secondary transfer device 22 is placed at the side, with respect to the intermediate transfer member 50, counter to the side of the tandem-type developing device 120. In the secondary transfer device 22, a secondary transfer belt 24, an endless belt, is stretched by a pair of rollers 23, and a transfer paper fed on the secondary transfer belt 24 and the intermediate transfer member 50 are capable of contacting. In the vicinity of the secondary transfer device 22, a fixing device 25 is placed. The fixing device 25 is equipped with a fixing belt 26 of an endless belt shape and a pressure roller 27 placed so as to be subjected to a pressure from the fixing roller.

In the tandem image forming apparatus, in the vicinity of the secondary transfer device 22 and the fixing device 25, placed is a sheet reverser 28 for reversing a sheet of transfer paper to form images on the both sides of the sheet of transfer paper.

Next, formation of the full color images (color copy) using the tandem-type developing device 120 will be described. First a document is set on the document platen 130 of the automated document feeder (ADF) 400, or alternatively the automated document feeder 400 is opened, the document is set on a contact glass 32 of the scanner and the automated document feeder 400 is closed.

By turning on a start switch (not shown), a first carriage 33 and a second carriage 34 start to be shifted by the scanner 300, with a lapse of time from the time of turning on a start switch during which the document has been conveyed to and arrived at the contact glass 32 when the document has been set in the automated document feeder 400, or immediately after the time of turning on a start switch in case of the document having been set on the contact glass 32. At this time, light is emitted from a light source of the first carriage 33 to the document, and reflected light from the document is further reflected toward the second carriage 34. The reflected light is further reflected by a mirror of the second carriage 34 and passes through an image-forming lens 35 into a read sensor 36 to thereby read the color document (color image). The read color images are processed as image information of black, yellow, magenta, and cyan.

Figure 5:
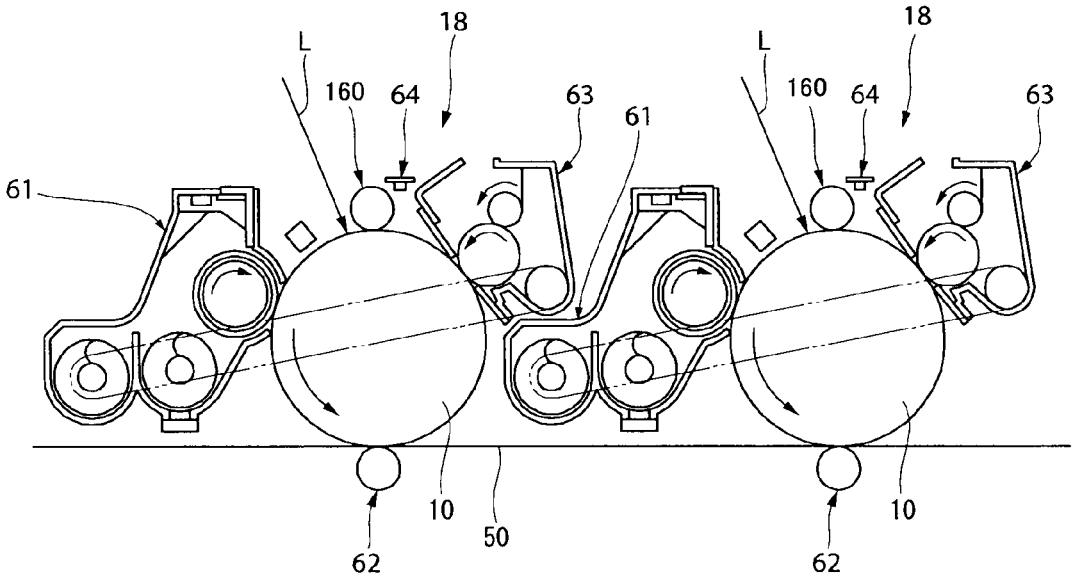
FIG. 5 is an enlarged partial schematic illustration of the image forming apparatus shown in FIG. 4.

Then each image information of black, yellow, magenta, and cyan is transmitted to each image forming unit 18 (black image-forming unit, yellow image-forming unit, magenta image-forming unit, and cyan image-forming unit) in the tandem-type developing device 120 to form each toner image of black, yellow, magenta, and cyan in each image forming unit. Namely, in the tandem-type developing device 120 each image forming unit 18 (a black image-forming unit, a yellow image-forming unit, a magenta image-forming unit, and a cyan image-forming unit) is, as shown in FIG. 5, equipped with a latent electrostatic image bearing member 10 (a black latent electrostatic image bearing member 10K, a yellow latent electrostatic image bearing member 10Y, a magenta latent electrostatic image bearing member 10M, and a cyan latent electrostatic image bearing member 10C), a charging device 160 for charging uniformly the latent electrostatic image bearing member 10, an exposing device for exposing (L in FIG. 5) the latent electrostatic image bearing member imagewise based on each color image information to thereby form latent electrostatic images corresponding to each color image on the latent electrostatic image bearing member, a developing device 61 for forming toner images of each color toner by developing the latent electrostatic images using the corresponding color toner (a black toner, a yellow toner, a magenta toner, and a cyan toner), a transfer-charging device 62 for transferring the toner images onto the intermediate transfer member 50, a cleaning device 63, and a charge eliminating device 64, and each image forming unit 18 is capable of forming corresponding monochrome images (black monochrome images, yellow monochrome images, magenta monochrome images, and cyan monochrome images) based on each color image information. Each of the black images formed on the black latent electrostatic image bearing member 10K, the yellow images formed on the yellow latent electrostatic image bearing member 10Y, the magenta images formed on the magenta latent electrostatic image bearing member 10M, and the cyan images formed on the cyan latent electrostatic image bearing member 10C thus formed is sequentially transferred (primarily transferred) onto the intermediate transfer member 50 rotated by the support rollers 14, 15, and 16. In this way, synthetic color images (color transfer images) are formed on the intermediate transfer member 50 by superimposing the black images, the yellow images, the magenta images, and the cyan images.

On the other hand in the paper feeder table 200, sheets (recording papers) are ejected from one of the multiple feeder cassettes 144 in a paper bank 143 by rotating one of the feeder rollers 142, separated as a sheet by a separation roller 145, and the sheet is sent to a paper feeder path 146, conveyed by a conveying roller 147 to lead to a paper feeder path 148 in the main body of the copying machine, and bumped against a resist roller 49. Alternatively, sheets (recording papers) on a manually-feeding tray 54 are ejected by rotating a feeder roller 142, separated as a sheet by a separation roller 145, and the sheet is sent to a paper feeder path 53, and in a manner similar to that described above bumped against a resist roller 49. Although the resist roller 49 is generally used with an earth applied, it may be used in a state in which a bias is applied for removing paper powders from the sheet. Timing of rotation of the resist roller 49 is adjusted to the movement of the synthetic color images (color transfer images) formed on the intermediate transfer member 50, a sheet (recording paper) is sent to between the intermediate transfer member 50 and the secondary transfer device 22, and the synthetic color images (color transfer images) are transferred (secondarily transferred) on the sheet (recording paper) by the secondary transfer device 22 to transfer and form the color images onto the sheet (recording paper). The residual toner particles remained on the intermediate transfer member 50 after image transfer are cleaned by the cleaning device 17 for the intermediate transfer member.

The sheet (recording paper) on which color images are transferred and formed is conveyed by the secondary transfer device 22 to fixing device 25, and the synthetic color images (color transfer images) are fixed on the sheet (recording paper) by heat and pressure at the fixing device 25. Subsequently, feed direction of the sheet (recording paper) is so controlled by a switch blade 55 that the sheet is ejected by an ejecting roller 56 and is stacked on an output tray 57. Alternatively the feed direction of the sheet is so controlled by a switch blade 55 that the sheet is sent to a sheet reverser 28 to be reversed and sent again to a transfer position; images are recorded also on the reverse side of the sheet, and the resultant sheet is ejected by the ejecting roller 56 and is stacked on the output tray 57.

In the image forming apparatus and the image forming method according to the present invention, high quality images are efficiently obtained by using the toner according to the present invention which has excellent storage stability, low temperature-fixing property, and stability of charge amounts, and causes less wax spent and resin spent to carrier particles and less occurrence of fogging.

According to the present invention, it is possible to solve the problems of the related arts and to provide a toner which is excellent in storage stability, low temperature-fixing property and stability of charge amounts and cause less wax spent and resin spent to carrier particles and less occurrence of fog; and the image forming apparatus and the image forming method using the toner.

EXAMPLES

Examples of the present invention will be described below; however the scope of the present invention is not limited to the following Examples.

In the following Examples and Comparative Examples, the softening point of resin, the softening point of rosin, the glass transition temperatures (Tg) of resin and rosin, and the acid value of resin and rosin are determined as follows.

<Measurement of Softening Point of Resin>

Using a flow tester (manufactured by Shimadzu Corporation, CFT-500D), 1 g resin as a sample was extruded through a nozzle having a diameter of 1 mm and a length of 1 mm by applying a load of 1.96 MPa from a plunger while heating at a temperature raising rate of 6° C./min. A fall amount of the plunger of the flow tester was plotted against temperature, and the temperature at which a half amount of the sample was flowed out was taken as a softening point.

<Measurement of Softening Point of Rosin>

(1) Preparation of Sample

A rosin (10 g) was melted on a hot plate at 170° C. for 2 hr. Thereafter in an open state the melted rosin was allowed to stand for one hour to be cooled spontaneously under an environment of a temperature of 25° C. and a relative humidity of 50%, and then pulverized by a coffee mill (National MK-61M) for 10 sec to prepare the sample.

(2) Measurement

Using a flow tester (manufactured by Shimadzu Corporation, CFT-500D), 1 g of the sample was extruded through a nozzle having a diameter of 1 mm and a length of 1 mm by applying a load of 1.96 MPa from a plunger while heating at a temperature raising rate of 6° C./min. A fall amount of the plunger of the flow tester was plotted against temperature, and the temperature at which a half amount of the sample was flowed out was taken as a softening point.

<Measurement of Glass Transition Temperature (Tg) of Resin>

Using a differential scanning calorimeter (manufactured by Seiko Electronic Industry Co., Ltd., DSC210), 0.01 g to 0.02 g of a sample was measured into an aluminum pan, heated to 200° C., cooled from the temperature to 0° C. at a temperature falling rate of 10° C./min, and then heated at a temperature raising rate of 10° C./min. The temperature at an intersection point of an extension line of a base line at or below an endothermic maximum peak temperature and a tangent line of the maximum slope from foot of the peak to the top of the peak was taken as a glass transition temperature.

<Acid Value of Resin and Rosin>

The acid value was measured according to the method described in JIS K0070 except that only the measurement solvent was changed from a mixture solvent of ethanol and ether of JIS K0070 to another mixture solvent of acetone and toluene (acetone:toluene=1:1 by volume) in these Examples.

Synthesis Example 1

Purification of Rosin

Into a 2,000 mL volumetric distilling flask equipped with a distilling tube, a reflux condenser, and a receiver, 1,000 g of a tall rosin was put, and distilled under reduced pressure of 1 kPa to collect a distillate from 195° C. to 250° C. as a main fraction. Hereinafter, a tall rosin subjected to purification is called as an unpurified rosin, and a rosin collected as the main fraction is called as a purified rosin.

Each rosin (20 g) was pulverized by a coffee mill (National MK-61M) for 5 sec, and 0.5 g of rosin particles that passed through a sieve having a sieve opening size of 1 mm were weighed and put into a bial (20 mL) for head space. From a head space gas sampled, impurities in the purified rosin were analyzed by a head space GC-MS method as follows. The result is shown in Table 1.

<Conditions for Measurement by Head Space GC-MS Method>

A. Head Space Sampler (manufactured by Agilent Co., HP7694)

Sample temperature: 200° C.
Loop temperature: 200° C.
Transfer line temperature: 200° C.
Equilibration time for sample heating: 30 min
Vial pressure gas: helium (He)
Vial pressurization time: 0.3 min
Loop charging time: 0.03 min
Equilibration time for loop: 0.3 min
Time for injection: 1 min B. GC (Gas Chromatography) (manufactured by Agilent Co., HP6890)

Analytic column: DB-1 (60 m-320 μm-5 μm)
Carrier: helium (He)
Flow conditions: 1 mL/min
Injection inlet temperature: 210° C.
Column head pressure: 34.2 kPa
Injection mode: split
Split ratio: 10:1
Oven temperature conditions: 45° C. (3 min)-10° C./min-280° C. (15 min)

MS (Mass Spectrometry) (manufactured by Agilent Co., HP5973)

Ionization method: EI (electron impact) method
Interface temperature: 280° C.
Ion source temperature: 230° C.
Quadrupole temperature: 150° C.
Detection mode: Scan 29 m/s to 350 m/s

TABLE 1

| | Hexanoic acid | Pentanoic acid | Benzaldehyde | N-hexenal | 2-pentylfuran | Softening point (° C.) | Acid value (mgKOH/g) |
|---|---|---|---|---|---|---|---|
| Purified rosin | $0.6 \times 10^7$ | $0.4 \times 10^7$ | $0.4 \times 10^7$ | $1.6 \times 10^7$ | $1.9 \times 10^7$ | 75.0 | 167 |

Example 1

Synthesis of Polyester Resin 1

Into a 5-liter four-neck flask equipped with a nitrogen inlet tube, a dewatering conduit, a stirrer, and a thermocouple, 950 parts by mass of 1,2-propanediol, 2,030 parts by mass of terephthalic acid, and 10.2 parts by mass of tin (II) dioctanoate were added, under a nitrogen atmosphere subjected to a condensation polymerization reaction at 225° C. for 15 hr, and then reacted at 235° C. at 9.0 kPa for one hour. The resultant reaction product was cooled to 170° C., to which 273 parts by mass of purified rosin was added, and the reaction product was reacted with the purified rosin at 200° C. for 15 hr. The resultant reaction product was cooled to 175° C., to which 305 parts by mass of itaconic acid was added, and the reaction product was reacted with the itaconic acid at a rising temperature to 215° C. in two hours and then at 215° C. at 10 kPa. In this way, [polyester resin 1] having a softening point of 105° C. was synthesized.

—Preparation of Polyester Resin Dispersion 1—

[Polyester resin 1] thus obtained was melt-kneaded by a continuous kneader at a jacket temperature of 160° C. for a residence time of 3 min. Then, into an aqueous medium tank prepared separately, 0.35% by mass of diluted ammonia water diluted with ion-exchange water was placed and, while heated at 125° C. by a heat exchanger, transferred at a flow rate of 0.05 L/min to the wet-type emulsion device (CAVITRON, supplied by EUROTEC Ltd.) at the same time as the polyester resin melted body (its transfer rate is 100 g/min). [Polyester resin dispersion 1](resin particle concentration: 32% by mass) made of polyester resins of a volume average particle diameter of 0.16 μm was prepared by operating the wet-type emulsion device under the conditions of a rotation speed of the rotator of 60 Hz and a pressure of 5 kg/cm$^2$.

—Preparation of Releasing Agent Dispersion 1—

The following materials were heated at 110° C., dispersed using a homogenizer (manufactured by IKA® Jappan K.K., Ultraturrax T50), and subjected to dispersion treatment using a HIGH PRESSURE MANTON GAULIN HOMOGENIZER (manufactured by Gaulin Co., Ltd.) to prepare [releasing agent dispersion 1] (concentration of the releasing agent: 24.5% by mass) made of releasing agents having a volume average particle diameter of 235 nm.

Paraffin wax (manufactured by NIPPON SEIRO Co., Ltd., FNP0090, melting point: 90° C.) . . . 6 1.5 parts by mass Anionic surfactant (manufactured by Dai-ichi Kogyo Seiyaku Co., Ltd, NEOGEN RK) . . . 5.5 parts by mass Ion-exchange water . . . 215 parts by mass —Preparation of Colorant Dispersion 1—

The following materials were mixed, dissolved, and dispersed for one hour using ULTIMIZER, a high-pressure-impact-type disperser, (manufactured by Sugino Machine Limited, HJP30006) to prepare [colorant dispersion 1] in which a colorant (cyan pigment) was dispersed. The average particle diameter of the colorants (cyan pigments) in the [colorant dispersion 1] thus obtained was 0.14 μm, the colorant particle concentration in the [colorant dispersion 1] was 26% by mass.

Cyan pigment (manufactured by TOYO INK MFG. Co., Ltd., C.I. Pigment Blue 15:3 (copper phthalocyanine)) . . . 2,550 parts by mass Anionic surfactant (manufactured by Dai-ichi Kogyo Seiyaku Co., Ltd, NEOGEN R) . . . 200 parts by mass Ion-exchange water . . . 8,600 parts by mass —Production of Toner Base Particles 1—

Into a 5-L cylindrical stainless container, 350 parts by mass of the [polyester resin dispersion 1], 41.5 parts by mass of the [releasing agent dispersion 1], and 285 parts by mass of deionized water were put, heated at 80° C., to which 6.5 parts by mass of an anionic surfactant (TAYCA POWER BN2060, manufactured by TAYCA Corporation) was added, and the resultant mixture was stirred at 150 rpm for 30 min and then cooled to room temperature. Subsequently to the mixture which was cooled to room temperature, 17.3 parts by mass of the [colorant dispersion 1], 1.25 parts by mass of non-ionic surfactant (IGEPALCO897, manufactured by Rhodia, Inc.), and 2.85 parts by mass of 10% by mass of polyaluminum chloride in a nitric acid aqueous solution as a flocculant were added and homogenized with a shearing force at 6,000 rpm for 5 min using Ultraturrax (manufactured by Ika Werke GmbH & Co. KG.). At this time dispersing and mixing were performed with the pH of the materials adjusted to 3.0 by addition of nitric acid. Since viscosity of the material solution was increased, the material solution was sufficiently stirred until it became homogenous, when it was set in a polymerization kettle equipped with a stirring device and a thermometer.

Then, while the stirring speed was kept at 500 rpm, the temperature was increased at a rate of 1° C./min by a mantle heater until it reached 45° C., when the stirring speed was raised to 520 rpm. The temperature was continued to be increased to enhance the increase in the volume average particle diameter by aggregation until it reached 55° C., when the temperature increase was stopped, the stirring speed was reduced to 460 rpm, and the material solution was started to stand in this state for one hour. To stop the increase in the volume average particle diameter, the pH was raised to 8.0 and the stirring speed was further reduced to 250 rpm. Next, to fuse aggregated particles, the temperature was raised to 75° C. and the material solution was kept at 75° C. for 10 min. After the aggregated particles were confirmed to have been fused in indeterminate shapes by microscopic observation, ice-cold water was poured in and the material solution was rapidly cooled at a temperature falling rate of 100° C./min to stop completely the increase in the volume average particle diameter.

In order to wash particle surfaces, the pH of the material solution was raised to 9.5 by a 1 N sodium hydroxide aqueous solution to perform alkali washing. After the material solution was filtered once, a cycle of dispersion and washing with deionized water was repeated three times, further the particle slurry was washed at 40° C. with its pH being adjusted at 4.1 by a 0.3 N nitric acid aqueous solution, and the particle slurry was finally washed with deionized heated water (40° C.). The resultant slurry was dried at 43° C. for 48 hr by a wind-circulating drying machine.

Next, in an aqueous solvent in a tank in which a 1% by mass concentration of N,N,N-trimethyl-[3-(4-perfluorononenyloxybenzamide)propyl]ammonium-iodide (hereinafter this is called as fluorinated compound (1)) was dispersed, the fluorinated compound (1) was mixed with the particles so that the concentration of the fluorinated compound (1) in particles is 0.1% by mass. After the fluorinated compound (1) was attached (bound), the particles are dried at 45° C. for 48 hr by a wind-circulating drying machine, and further dried on a shelf at 30° C. for 10 hr. Then the particles are passed through a sieve of a mesh size of 75 μm to produce [toner base particles 1].

Per 100 parts by mass of [toner base particles 1] thus obtained, 0.4 parts by mass of hydrophobic silica (supplied by Clariant (Japan) K.K., H-2000, with a 70% hydrophobizing degree and a 140 $m^2/g$ BET specific surface area), 1.1 parts by mass of titanium oxide (manufactured by Tayca Corporation, MT-150A, with a 65% hydrophobizing degree and a 65 $m^2/g$ BET specific surface area), and 1.2 parts by mass of silica having an approximately spherical shape and an average primary particle diameter of 0.15 μm are added, subjected to a mixing treatment for 60 sec by Henschel Mixer at a circumferential speed of 40 m/sec, and then passed through a sieve of a mesh size of 90 μm to produce [toner 1].

Example 2

Production of Toner 2

[Toner 2] was produced in the same manner as in Example 1 except that the following [polyester resin 2] was used in place of the [polyester resin 1].

—Synthesis of Polyester Resin 2—

Into a 5-liter four-neck flask equipped with a nitrogen inlet tube, a dewatering conduit, a stirrer, and a thermocouple, 900 parts by mass of 1,2-propanediol, 100 parts by mass of 1,3-propanediol, 50 parts by mass of glycerin, 1,850 parts by mass of terephthalic acid, and 12.4 parts by mass of tin (II) dioctanoate were added, under a nitrogen atmosphere subjected to a condensation polymerization reaction at 243° C. for 20 hr, and then reacted at 243° C. at 9.0 kPa for one hour. The resultant reaction product was cooled to 165° C., to which 289 parts by mass of purified rosin was added, and the reaction product was reacted with the purified rosin at 200° C. for 20 hr. The resultant reaction product was cooled to 170° C., to which 320 parts by mass of itaconic acid was added, and the reaction product was reacted with the itaconic acid at a rising temperature to 220° C. in two hours and then at 220° C. at 8 kPa. In this way, [polyester resin 2] having a softening point of 115° C. was synthesized.

Example 3

Production of Toner 3

[Toner 3] was produced in the same manner as in Example 1 except that the following [polyester resin 3] was used in place of the [polyester resin 1].

—Synthesis of Polyester Resin 3—

Into a 5-liter four-neck flask equipped with a nitrogen inlet tube, a dewatering conduit, a stirrer, and a thermocouple, 970 parts by mass of 1,2-propanediol, 120 parts by mass of 2,3-butanediol, 1,950 parts by mass of terephthalic acid, and 8.2 parts by mass of tin (II) dioctanoate were added, under a nitrogen atmosphere subjected to a condensation polymerization reaction at 225° C. for 13 hr, and then reacted at 220° C. at 9.0 kPa for one hour. The resultant reaction product was cooled to 170° C., to which 275 parts by mass of purified rosin was added, and the reaction product was reacted with the purified rosin at 210° C. for 18 hr. The resultant reaction product was cooled to 180° C., to which 302 parts by mass of itaconic acid was added, and the reaction product was reacted with the itaconic acid at a rising temperature to 230° C. in two hours and then at 230° C. at 10 kPa. In this way, [polyester resin 3] having a softening point of 95° C. was synthesized.

Example 4

Production of Toner 4

[Toner 4] was produced in the same manner as in Example 1 except that carnauba wax (manufactured by CERARICA NODA Co., Ltd., WA-03) was used in place of paraffin wax.

Example 5

Production of Toner 5

[Toner 5] was produced in the same manner as in Example 1 except that carbon black (MOGUL L, manufactured by Cabot Corporation) was used in place of the cyan pigment.

Example 6

Production of Toner 6

—Synthesis of Nonlinear Polyester Resin 1—

Into a reaction tank equipped with a cooling tube, a stirrer, and a nitrogen inlet tube, 132 parts by mass of bisphenol A propyleneoxide dimolar adduct, 371 parts by mass of bisphenol A propyleneoxide trimolar adduct, 20 parts by mass of bisphenol A ethyleneoxide dimolar adduct, 125 parts by mass of phenol novolac (average polymerization degree: 5) propyleneoxide pentamolar adduct, 201 parts by mass of terephthalic acid, 25 parts by mass of maleic acid anhydride, 35 parts by mass of esters of dimethylterephthalic acid, and 2 parts by mass of titanyl bis(triethanolaminate) as a condensation catalyst were put and reacted at 230° C. for 10 hr with produced water under nitrogen gas flow distilled away.

Then, the reaction product was reacted at a reduced pressure from 5 mmHg to 20 mmHg until the acid value became 2 mg KOH/g or less, when it was cooled to 180° C. and 65 parts by mass of trimellitic anhydride was added to it. The mixture was reacted at normal pressure in the hermetically-sealed tank for two hours, then removed from the tank, cooled to room temperature, and pulverized to synthesize [nonlinear polyester resin 1].

Regarding the [nonlinear polyester resin 1] thus obtained, the softening point temperature was 144° C., the acid value was 30 mg KOH/g, the hydroxyl group number was 16 mg KOH/g, the glass transition temperature (Tg) was 59° C., the number average molecular weight (Mn) was 1,410, and the Mw/Mn was 4.2.

[Nonlinear polyester resin dispersion 1] was prepared using [nonlinear polyester resin 1] thus obtained in the same manner as in Example 1, where [polyester resin dispersion 1] was prepared using [polyester resin 1].

Into a 5-L cylindrical stainless container, 350 parts by mass of the [nonlinear polyester resin dispersion 1], 41.5 parts by mass of the [releasing agent dispersion 1], and 280 parts by mass of deionized water were added, heated at 85° C., to which 6.5 parts by mass of anionic surfactant (TAYCA POWER BN2060, manufactured by TAYCA Corporation) was added, and the resultant mixture was stirred at 150 rpm for 30 min and then cooled to room temperature.

Subsequently to the mixture which was cooled to room temperature, 17.3 parts by mass of the [colorant dispersion 1], 1.25 parts by mass of non-ionic surfactant (IGEPALCO897, manufactured by Rhodia, Inc.), and 2.9 parts by mass of 10% by mass of polyaluminum chloride in a nitric acid aqueous solution as a flocculant were added and homogenized with a shearing force at 6,000 rpm for 5 min using Ultraturrax (manufactured by Ika Werke GmbH & Co. KG.). At this time dispersing and mixing were performed with pH of the materials adjusted to 3.0 by addition of nitric acid. Since the viscosity of the material solution was increased, the material solution was stirred sufficiently until homogenous, when it was set in a polymerization kettle equipped with a stirring device and a thermometer.

—Production of Core Particles—

Then, while stirring speed was kept at 500 rpm, the temperature was increased at a rate of 1° C./min by a mantle heater until it reaches 45° C., when the stirring speed was raised to 520 rpm. The temperature was continued to be increased to enhance the increase in the volume average particle diameter by aggregation until it reaches 55° C., when the temperature increase was stopped, the stirring speed was reduced to 460 rpm, and the material solution was started to be left in this state for one hour. To stop the increase in the volume average particle diameter, pH was raised to 8.0 and the stirring speed was further reduced to 250 rpm. Next, to fuse the aggregated particles, the temperature was raised to 75° C. and the material solution was kept at 75° C. for 10 min. After the aggregated particles were confirmed to have fused in indeterminate forms by microscopic observation, ice-cold water was poured in and the material solution was rapidly cooled at a temperature falling rate of 100° C./min to stop completely the increase in the volume average particle diameter. After rapid cooling, the resultant dispersion was concentrated using a centrifuge so that the solid content of the dispersion became 20% by mass, and [core particle 1] was produced.

Then, the temperature of the dispersion was increased to 60° C., 30 parts by mass of the [polyester resin dispersion 1] prepared in Example 1 was added for the purpose of coating particle surfaces, and the pH of the dispersion was decreased to 3.2. Subsequently in order to enhance adsorption and coating of the coating particles onto surfaces of core fusion particles, 0.2 parts by mass of a flocculant (10% by mass of polyaluminum chloride in a nitric acid aqueous solution) was added, and to enhance fusion-bonding of the particles on the surfaces of core fusion particles, the resultant mixture was kept at 50° C. for 7 hr. After amorphous polymer coating layers were confirmed to have been fusion bonded by electron microscopic observation, for the purpose of washing particle surfaces, the pH of the dispersion was raised to 9.5 by a 1 N sodium hydroxide aqueous solution to perform alkali washing. After the dispersion was filtered once, a cycle of dispersion and washing with deionized water was repeated three times, further the particle slurry was washed at 40° C. with its pH being adjusted at 4.1 by a 0.3 N nitric acid aqueous solution, and finally the particle slurry was washed with deionized heated water (40° C.). This particle slurry was dried to produce [toner base particles 6].

Then [toner 6] was produced by mixing with external additive in the same manner as in Example 1 except that the [toner base particles 6] thus obtained was used in place of the [toner base particles 1].

Example 7

Production of Toner 7

[Polyester resin dispersion 2] was produced in the same manner as in Example 1 except that in the preparation of [polyester resin dispersion 1], [polyester resin 2] of Example 2 was used in place of [polyester resin 1].

Next, [toner base particles 7] and [toner 7] were produced in the same manner as in Example 6 except that in coating of [core particle 1], the [polyester resin dispersion 2] was used in place of the [polyester resin dispersion 1]

Comparative Example 1

Production of Toner 8

[Toner 8] was produced in the same manner as in Example 1 except that in synthesis of [polyester resin 1], 950 parts by mass of 1,3-propanediol was used in place of 950 parts by mass of 1,2-propanediol.

Comparative Example 2

Production of Toner 9

[Toner 9] was produced in the same manner as in Example 1 except that in synthesis of [polyester resin 1], 950 parts by mass of 2,3-butanediol was used in place of 950 parts by mass of 1,2-propanediol.

Comparative Example 3

Production of Toner 10

[Toner 10] was produced in the same manner as in Example 1 except that unpurified tall rosin was used in place of the purified rosin.

Comparative Example 4

Production of Toner 11

[Toner 11] was produced in the same manner as in Example 1 except that the following [polyester resin A] was used in place of [polyester resin 1]

—Synthesis of Polyester Resin A—

Into a 5-liter four-neck flask equipped with a nitrogen inlet tube, a dewatering conduit, a stirrer, and a thermocouple, 900 parts by mass of 1,2-propanediol, 2,040 parts by mass of terephthalic acid, and 10.5 parts by mass of tin (II) dioctanoate were added, under a nitrogen atmosphere subjected to a condensation polymerization reaction at 200° C. for 8 hr, and then reacted at 220° C. at 7.0 kPa for one hour. The resultant reaction product was cooled to 150° C., to which 304 parts by mass of purified rosin was added, and the reaction product was reacted with the purified rosin at 180° C. for 8 hr. The resultant reaction product was cooled to 155° C., to which 320 parts by mass of itaconic acid was added, and the reaction product was reacted with the itaconic acid at a rising temperature to 190° C. in two hours and then at 190° C. at 5 kPa. In this way, [polyester resin A] having a softening point of 70° C. was synthesized.

Comparative Example 5

Production of Toner 12

[Toner 12] was produced in the same manner as in Example 1 except that the following [polyester resin B] was used in place of the [polyester resin 1].

—Synthesis of Polyester Resin B—

Into a 5-liter four-neck flask equipped with a nitrogen inlet tube, a dewatering conduit, a stirrer, and a thermocouple, 850 parts by mass of 1,2-propanediol, 2,000 parts by mass of terephthalic acid, and 10.1 parts by mass of tin (II) dioctanoate were added, under a nitrogen atmosphere subjected to a condensation polymerization reaction at 230° C. for 25 hr, and then reacted at 235° C. at 11.0 kPa for two hours. The resultant reaction product was cooled to 170° C., to which 282 parts by mass of purified rosin was added, and the reaction product was reacted with the purified rosin at 210° C. for 30 hr. The resultant reaction product was cooled to 185° C., to which 320 parts by mass of itaconic acid was added, and the reaction product was reacted with the itaconic acid at a rising temperature to 215° C. in two hours and then at 215° C. at 12 kPa. In this way, [polyester resin B] having a softening point of 130° C. was synthesized.

Comparative Example 6

Production of Toner 13

[Toner 13] was produced in the same manner as in Example 1 except that the following [polyester resin 4] was used in place of [polyester resin 1].

—Synthesis of Polyester Resin 4—

Into a 5-liter four-neck flask equipped with a nitrogen inlet tube, a dewatering conduit, a stirrer, and a thermocouple, 200 parts by mass of 1,2-propanediol, 900 parts by mass of 1,3-propanediol, 60 parts by mass of glycerin, 1,820 parts by mass of terephthalic acid, and 12.5 parts by mass of tin (II) dioctanoate were added, under a nitrogen atmosphere subjected to a condensation polymerization reaction at 247° C. for 20 hr, and then reacted at 247° C. at 9.0 kPa for one hour. The resultant reaction product was cooled to 165° C., to which 225 parts by mass of purified rosin was added, and the reaction product was reacted with the purified rosin at 200° C. for 20 hr. The resultant reaction product was cooled to 170° C., to which 310 parts by mass of itaconic acid was added, and the reaction product was reacted with the itaconic acid at a rising temperature to 220° C. in two hours and then at 220° C. at 8 kPa. In this way, [polyester resin 4] having a softening point of 121° C. was synthesized.

Example 8

Production of Toner 14

After 30 parts by mass of hydrophobic silica (H-2000, with a 70% hydrophobizing degree and a 140 $m^2/g$ BET specific surface area, supplied by Clariant (Japan) K.K.), 100 parts by mass of ion-exchange water, and 100 parts by mass of ethanol were stirred for about 15 min by a dispersing machine, 20 parts by mass of a 5% by mass 3-(triethoxysilyl)propylsuccinic anhydride solution was added to perform surface treatment, the resultant mixture was dried at a reduced pressure, and the powder thus obtained was pulverized by a pulverizer to obtain [surface-treated silica 1] having a 40% hydrophobizing degree and a 80 $m^2/g$ BET specific surface area.

Toner 14 of Example 8 was produced in the same manner as in Example 1 except that the above [surface-treated silica 1] was used in place of the hydrophobic silica (H-2000, with a 70% hydrophobizing degree and a 140 $m^2/g$ BET specific surface area, supplied by Clariant (Japan) K.K.).

Example 9

Production of Toner 15

After 10 parts by mass of hydrophobic silica (H-2000, with a 70% hydrophobizing degree and a 140 $m^2/g$ BET specific surface area, supplied by Clariant (Japan) K.K.), 100 parts by mass of ion-exchange water, and 100 parts by mass of ethanol were stirred for about 20 min by a dispersing machine, 15 parts by mass of a 5% by mass 3-(triethoxysilyl)propylsuccinic anhydride solution was added to perform surface treatment, the resultant mixture was dried at a reduced pressure, and the powder thus obtained was pulverized by a pulverizer to obtain [surface-treated silica 2] having a 60% hydrophobizing degree and a 320 $m^2/g$ BET specific surface area.

Toner 15 of Example 9 was produced in the same manner as in Example 1 except that the above [surface-treated silica 2] was used in place of the hydrophobic silica (H-2000, with a 70% hydrophobizing degree and a 140 $m^2/g$ BET specific surface area, supplied by Clariant (Japan) K.K.).

Example 10

Production of Toner 16

After 13 parts by mass of titanium oxide (MT-150A, with a 65% hydrophobizing degree and a 65 $m^2/g$ BET specific surface area, manufactured by Tayca Corporation), 100 parts by mass of ion-exchange water, and 100 parts by mass of ethanol were stirred for about 20 min by a dispersing machine, 25 parts by mass of a 5% by mass 3-(triethoxysilyl) propylsuccinic anhydride solution was added to perform surface treatment, the resultant mixture was dried at a reduced pressure, and the powder thus obtained was pulverized by a pulverizer to obtain [surface-treated titanium oxide 1] having a 35% hydrophobizing degree and a 10 $m^2/g$ BET specific surface area.

Toner 16 of Example 10 was produced in the same manner as in Example 1 except that the above [surface-treated titanium oxide 1] was used in place of the titanium oxide (MT-150A, with a 65% hydrophobizing degree and a 65 $m^2/g$ BET specific surface area, manufactured by Tayca Corporation).

Example 11

Production of Toner 17

After 24 parts by mass of titanium oxide (MT-150A, with a 65% hydrophobizing degree and a 65 $m^2/g$ BET specific surface area, manufactured by Tayca Corporation), 100 parts by mass of ion-exchange water, and 100 parts by mass of ethanol were stirred for about 30 min by a dispersing machine, 15 parts by mass of a 5% by mass 3-(triethoxysilyl) propylsuccinic anhydride solution was added to perform surface treatment, the resultant mixture was dried at a reduced pressure, and the powder thus obtained was pulverized by a pulverizer to obtain [surface-treated titanium oxide 2] having a 50% hydrophobizing degree and a 220 $m^2/g$ BET specific surface area.

Toner 17 of Example 11 was produced in the same manner as in Example 1 except that the above [surface-treated titanium oxide 2] was used in place of the titanium oxide (MT-150A, with a 65% hydrophobizing degree and a 65 $m^2/g$ BET specific surface area, manufactured by Tayca Corporation).

Example 12

Production of Toner 18

Toner 18 of Example 12 was produced in the same manner as in Example 1 except that 1.5 parts by mass of silica having an average primary particle diameter of 0.05 μm and approximately spherical shapes were used in place of 1.2 parts by mass of silica having an average primary particle diameter of 0.15 μm and approximately spherical shapes.

Example 13

Production of Toner 19

Toner 19 of Example 13 was produced in the same manner as in Example 1 except that 1.0 part by mass of silica having an average primary particle diameter of 0.2 μm and approximately spherical shapes were used in place of 1.2 parts by mass of silica having an average primary particle diameter of 0.15 μm and approximately spherical shapes.

Example 14

Production of Toner 20

Toner 20 of Example 14 was produced in the same manner as in Example 1 except that the following [toner base particles 20] were used in place of the [toner base particles 1].

—Toner Base Particles 20—

Into a 5-L cylindrical stainless container, 340 parts by mass of the [polyester resin dispersion 1], 50.5 parts by mass of the [releasing agent dispersion 1], and 289 parts by mass of deionized water were put, heated at 80° C., to which 6.5 parts by mass of an anionic surfactant (TAYCA POWER BN2060, manufactured by TAYCA Corporation) was added, and the resultant mixture was stirred at 150 rpm for 30 min and then cooled to room temperature. Subsequently to the mixture which was cooled to room temperature, 17.3 parts by mass of the [colorant dispersion 1], 1.25 parts by mass of a non-ionic surfactant (IGEPALCO897, manufactured by Rhodia, Inc.), and 2.82 parts by mass of 10% by mass of polyaluminum chloride in a nitric acid aqueous solution as a flocculant were added and homogenized with a shearing force at 8,000 rpm for 5 min using Ultraturrax (manufactured by Ika Werke GmbH & Co. KG.). At this time dispersing and mixing were performed with the pH of the materials adjusted to 3.0 by addition of nitric acid. Since the viscosity of the material solution was increased, the material solution was sufficiently stirred until homogenous, when it was set in a polymerization kettle equipped with a stirring device and a thermometer.

Then, while the stirring speed was kept at 700 rpm, the temperature was increased at a rate of 1° C./min by a mantle heater until it reached 45° C., when the stirring speed was raised to 820 rpm. The temperature was continued to be increased to enhance the increase in the volume average particle diameter by aggregation until it reached 55° C., when the temperature increase was stopped, the stirring speed was reduced to 520 rpm, and the material solution was started to stand in this state for one hour. To stop the increase in the volume average particle diameter, the pH was raised to 8.0 and the stirring speed was further reduced to 250 rpm. Next, to fuse aggregated particles together, the temperature was raised to 75° C. and the material solution was kept at 75° C. for 10 min. After the aggregated particles were confirmed to have been fused in indeterminate forms by microscopic observation, ice-cold water was poured in and the material solution was rapidly cooled at a temperature falling rate of 100° C./min to completely stop the increase in the volume average particle diameter.

In order to wash particle surfaces, the pH of the material solution was raised to 9.5 by a 1 N sodium hydroxide aqueous solution to perform alkali washing. After the material solution was filtered once, a cycle of dispersion and washing with deionized water was repeated three times, further the particle slurry was washed at 40° C. with its pH being adjusted at 4.1 by a 0.3 N nitric acid aqueous solution, and the particle slurry was finally washed with deionized heated water (40° C.). The resultant slurry was dried at 43° C. for 48 hr by a wind-circulating drying machine.

Next, in an aqueous solvent in a tank in which a 1% by mass concentration of fluorinated compound (1) was dispersed, the fluorinated compound (1) was mixed with the particles so that the concentration of the fluorinated compound (1) in particles is 0.1% by mass. After the fluorinated compound was attached (bound), the particles are dried at 45° C. for 48 hr by a wind-circulating drying machine, and further dried on a shelf at 30° C. for 10 hr. Then the particles are passed through a sieve of a mesh size of 75 μm to produce [toner base particles 20].

Example 15

Production of Toner 21

Toner 21 of Example 15 was produced in the same manner as in Example 1 except that the following [toner base particles 21] were used in place of the [toner base particles 1].

—Production of Toner Base Particles 21—

Into a 5-L cylindrical stainless container, 350 parts by mass of the [polyester resin dispersion 1], 45.2 parts by mass of the [releasing agent dispersion 1], and 295 parts by mass of deionized water were put, heated at 80° C., to which 6.2 parts by mass of an anionic surfactant (TAYCA POWER BN2060, manufactured by TAYCA Corporation) was added, and the resultant mixture was stirred at 150 rpm for 30 min and then cooled to room temperature. Subsequently to the mixture which was cooled to room temperature, 17.3 parts by mass of the [colorant dispersion 1], 1.27 parts by mass of a non-ionic surfactant (IGEPALCO897, manufactured by Rhodia, Inc.), and 2.92 parts by mass of 10% by mass of polyaluminum chloride in a nitric acid aqueous solution as a flocculent were added and homogenized with a shearing force at 4,000 rpm for 5 min using Ultraturrax (manufactured by Ika Werke GmbH & Co. KG.). At this time dispersing and mixing were performed with the pH of the materials adjusted to 3.0 by addition of nitric acid. Since viscosity of the material solution was increased, the material solution was sufficiently stirred until homogenous, when it was set in a polymerization kettle equipped with a stirring device and a thermometer.

Then, while the stirring speed was kept at 300 rpm, the temperature was increased at a rate of 1° C./min by a mantle heater until it reached 45° C., when the stirring speed was raised to 400 rpm. The temperature was continued to be increased to enhance the increase in the volume average particle diameter by aggregation until it reached 55° C., when the temperature increase was stopped, the stirring speed was reduced to 340 rpm, and the material solution was started to stand in this state for one hour. To stop the increase in the volume average particle diameter, the pH was raised to 8.0 and the stirring speed was further reduced to 220 rpm. Next, to fuse the aggregated particles, the temperature was raised to 75° C. and the material solution was kept at 75° C. for 10 min. After the aggregated particles were confirmed to have fused in indeterminate forms by microscopic observation, ice-cold water was poured in and the material solution was rapidly cooled at a temperature falling rate of 100° C./min to completely stop the increase in the volume average particle diameter.

In order to wash particle surfaces, the pH of the material solution was raised to 9.5 by a 1 N sodium hydroxide aqueous solution to perform alkali washing. After the material solution was filtered once, a cycle of dispersion and washing with deionized water was repeated three times, further the particle slurry was washed at 40° C. with its pH being adjusted at 4.1 by a 0.3 N nitric acid aqueous solution, and the particle slurry was finally washed with deionized heated water (40° C.). The resultant slurry was dried at 43° C. for 48 hr by a wind-circulating drying machine.

Next, in an aqueous solvent in a tank in which a 1% by mass concentration of fluorinated compound (1) was dispersed, the fluorinated compound (1) was mixed with the particles so that the concentration of the fluorinated compound (1) in particles is 0.1% by mass. After the fluorinated compound was attached (bound), the particles are dried at 45° C. for 48 hr by a wind-circulating drying machine, and further dried on a shelf at 30° C. for 10 hr. Then the particles are passed through a sieve of a mesh size of 75 μm to produce [toner base particles 21].

Next, particle diameters and particle size distribution, and average circularity are determined as follows for each toner thus obtained. The results are shown in Table 2.

<Measurement of Particle Diameters and Particle Size Distribution>

For measurement of particle diameters and particle size distribution of toners, Coulter Multisizer II (manufactured by Coulter Company Limited) was used.

First to 100 ml to 150 ml of an electrolyte solution, 0.1 ml to 5 ml of a surfactant (alkylbenzene sulfonate salt) was added as a dispersing agent. After the sample for measurement (2 mg to 20 mg) was added, the electrolyte liquid in which the sample is suspended is subjected to dispersion treatment for 1 min to 3 min by an ultrasonic dispersion device. The weights and numbers of the toner particles are determined by the measurement device using a 100 μm aperture as an aperture to calculate weight distribution and number distribution. From the distributions thus produced, the weight average particle diameter ($D_4$) and the number average particle diameter (Dn) of the toner are obtained. Isoton-II (manufactured by Coulter Company Limited) was used as an electrolyte liquid.

As channels, 13 channels were used, that is, channels of sizes of 2.00 μm or more to less than 2.52 μm; 2.52 μm or more to less than 3.17 μm; 3.17 μm or more to less than 4.00 μm; 4.00 μm or more to less than 5.04 μm; 5.04 μm or more to less than 6.35 μm; 6.35 μm or more to less than 8.00 μm; 8.00 μm or more to less than 10.08 μm; 10.08 μm or more to less than 12.7 μm; 12.70 μm or more to less than 16.00 μm; 16.00 μm or more to less than 20.20 μm; 20.20 μm or more to less than 25.40 μm; 25.40 μm or more to less than 32.00 μm; 32.00 μm or more to less than 40.30 μm; and thus particles of diameter of 2.00 μm or more to less than 40.30 μm were covered for the measurement.

<Measurement of Average Circularity>

The average circularity of the toner was determined by measuring shapes and distribution of the toner using a flow type particle image analyser ("FPIA-2100" manufactured by SYSMEX Corp.) and analyzing them using analysis software (FPIA-2100 Data Processing Program for FPIA version 00-10). The average circularity was evaluated according to the following criteria.

Specifically into a 100 ml glass beaker, 0.1 ml to 0.5 ml of a 10% by mass surfactant (an alkylbenzene sulfonate salt, NEOGEN SC-A; manufactured by Dai-ichi Kogyo Seiyaku Co., Ltd.) was put, 0.1 g to 0.5 g of each toner was added and agitated by a micro spatula, and then to the resultant mixture 80 ml of ion-exchange water was added. The dispersion thus obtained was subjected to 3-min dispersion treatment using an ultrasonic dispersing device (manufactured by HONDA ELECTRONICS CO., LTD). The dispersion concentration was made 5,000 particles/μl to 15,000 particles/μl, and the shape and the distribution of the toner particles are determined using the FPIA-2100.

—Evaluation Criteria—

A: good

B: not good

TABLE 2

| | | Particle diameters and particle size distribution | | | Average circularity | |
|---|---|---|---|---|---|---|
| | | W. av. | No. av. | | | |
| | Example | particle di.: $D_4$ (μm) | particle di.: Dn (μm) | $D_4$/Dn | Value | Evaluation |
| Ex. 1 | Toner 1 | 5.1 | 4.4 | 1.16 | 0.95 | A |
| Ex. 2 | Toner 2 | 5.5 | 4.5 | 1.22 | 0.94 | A |
| Ex. 3 | Toner 3 | 5.2 | 4.6 | 1.13 | 0.97 | A |
| Ex. 4 | Toner 4 | 6.0 | 4.9 | 1.22 | 0.99 | A |
| Ex. 5 | Toner 5 | 5.6 | 4.6 | 1.22 | 0.94 | A |
| Ex. 6 | Toner 6 | 5.7 | 4.7 | 1.21 | 0.96 | A |
| Ex. 7 | Toner 7 | 5.8 | 5.5 | 1.05 | 0.97 | A |
| Comp. Ex. 1 | Toner 8 | 6.5 | 5.1 | 1.27 | 0.91 | B |
| Comp. Ex. 2 | Toner 9 | 6.2 | 4.8 | 1.29 | 0.94 | A |
| Comp. Ex. 3 | Toner 10 | 5.3 | 4.7 | 1.13 | 0.90 | B |
| Comp. Ex. 4 | Toner 11 | 5.6 | 4.8 | 1.17 | 0.95 | A |
| Comp. Ex. 5 | Toner 12 | 6.3 | 4.8 | 1.31 | 0.86 | B |
| Comp. Ex. 6 | Toner 13 | 5.3 | 4.7 | 1.13 | 0.96 | A |
| Ex. 8 | Toner 14 | 5.6 | 4.9 | 1.14 | 0.94 | A |
| Ex. 9 | Toner 15 | 6.1 | 5.0 | 1.22 | 0.97 | A |
| Ex. 10 | Toner 16 | 4.9 | 4.0 | 1.23 | 0.95 | A |
| Ex. 11 | Toner 17 | 5.3 | 4.1 | 1.29 | 0.94 | A |
| Ex. 12 | Toner 18 | 4.8 | 3.9 | 1.23 | 0.94 | A |
| Ex. 13 | Toner 19 | 5.6 | 4.6 | 1.22 | 0.95 | A |
| Ex. 14 | Toner 20 | 2.8 | 2.3 | 1.22 | 0.85 | B |
| Ex. 15 | Toner 21 | 7.3 | 6.0 | 1.22 | 0.97 | A |

—Production of Carrier—

Ferrite (F-300, manufactured by Powdertech K.K.) was coated with a spray of a coating solution prepared by dispersing in toluene a silicone resin treated with an aminosilane coupling agent, to produce carrier having coating layer thickness of 0.4 μm.

—Production of Developer—

Each toner thus obtained (7 parts by mass) and 93 parts by mass of the carrier were homogenously mixed using Turbula Mixer (manufactured by Willy A. Bachofen (WAB) AG Maschinenfabrik, T2F) for 3 min to produce a two-component developer.

Next characteristics of each toner were evaluated as follows using each toner and each two-component developer thus obtained. The results are shown in Table 3.

<Carrier Spent>

An image forming apparatus (manufactured by Ricoh Company, Ltd., IPSiO Color 8150) was modified as an oilless fixing system for use as an evaluation machine. Developers of the evaluation machine, after the machine has output continuously 30,000 sheets of an image chart with a 50% image area in the chart using a monochrome mode, were removed and a moderate quantity thereof was put in a gage set up by screens of a 32 μm mesh, to which air was blown to separate toner and carrier. Carrier (1.0 g) thus obtained was put in a 50-ml glass bottle, to which 10 ml of chloroform was added. The glass bottle with the carrier and chloroform was shaken manually for 50 strokes and then left to stand for 10 min. Subsequently the supernatant chloroform solution was put in a glass cell, the transmission of the chloroform solution was determined using a turbidity meter to be evaluated according to the following criteria.

[Evaluation Criteria]

A: 95% or more transmission

B: 90% to 94% transmission

C: 80% to 89% transmission

D: 70% to 79% transmission

E: 69% or less transmission

<Fog>

Under the conditions of a 35° C. temperature and a 95% relative humidity, using an evaluation machine that is a modified image forming apparatus (manufactured by Ricoh Company, Ltd., IPSiO Color8150) in which an oilless fixing system is used, 100,000 sheets of a chart with a 7% image area in the chart were continuously output for each toner as an endurance test, then image densities of a background part on a transferred paper were determined using a reflection densitometer X-Rite 938 (manufactured by X-Rite Co., Ltd.). Taking a reflection density of a sheet of paper as 0, 10 sites of solid white images were measured, the average difference in reflection density of solid white images from paper was taken as ΔID, and the fog densities were evaluated according to the following criteria.

[Evaluation Criteria]

A: ΔID is less than 0.1

B: ΔID is 0.1 or more to less than 0.3

C: ΔID is 0.3 or more

<Charge Amount Distribution>

After the fogging test was completed, developers collected from a sleeve of a developing unit were subjected to a charge amount distribution measurement device (E-SPART ANALYZER, manufactured by Hosokawa Micron Corporation) and a Q/d distribution (fC/μm) was measured thereby from which measurement values a peak width at half height was calculated. The conditions under which E-SPART ANALYZER was operated were a flow rate of nitrogen gas of 0.3 NL/min, and a gas pressure of 0.3 atmospheric pressures. As indexes for charge amount distributions, a mode value (peak value) [q/d] and the distribution width at the half of the modal height (peak width at half height) was used, and charge amount distributions were evaluated according to the following criteria.

[Evaluation Criteria]

A: mode value of 0.25 fC/μm or more, and peak width at half height of less than 0.2

B: mode value of 0.15 fC/μm or more to less than 0.25 fC/μm, and peak width at half height of 0.2 or more to less than 0.3

C: mode value of less than 0.15 fC/μm, and peak width at half height of 0.3 or more <Heat-Resistance/Storage Stability>

Each toner (10 g) was measured into a 30-ml glass container (internal diameter: 26 mm), the glass bottle was capped under environmental conditions of a 23±2° C. temperature and a 52±3% relative humidity, tapped 150 times and left for one hour in a thermostat chamber at a 50° C. temperature and a 80% relative humidity. Subsequently, the glass bottle was opened in the thermostat chamber, left for 24 hr, and the penetration degree was measured by a penetrometer and evaluated according to the following criteria. For tapping a tapping machine (manufactured by Kuramochi Kagaku Kikai Seisakusho K.K.) was used, the penetration degree was measured using a penetrometer (manufactured by Nikka Engineering K.K.) (according to JIS K2207).

[Evaluation Criteria]

A: penetration degree of 30 mm or more

B: penetration degree of 20 mm to 29 mm

C: penetration degree of 15 mm to 19 mm

D: penetration degree of less than 14 mm

<Evaluation of Low Temperature-Fixing Property>

Onto sheets of transfer paper of regular paper and cardboard (type 6200 manufactured by Ricoh Company, Ltd and copy-printing paper <135> manufactured by NBS Ricoh Co., Ltd.), solid images of a 0.85±0.1 mg/cm$^2$ toner adhesion amount were produced at various temperatures of a fixing belt to perform fixation tests. The upper limit fixation temperature was defined as an upper limit temperature at or below which no hot offset was caused on a sheet of regular paper. The solid images are produced on a sheet of regular paper at 3.0 cm from the front edge relative to the feed direction. On the other hand, the lower limit fixation temperature was measured using sheets of cardboard and defined as a fixing roller temperature at or above which almost no image drop of the fixed images due to drawing with a 50 g load by a drawing tester (AD-401, manufactured by Ueshima Seisakusho Co., Ltd.) was caused. The lower limit fixing temperature was evaluated according to the following criteria.

[Evaluation Criteria]

A: lower limit fixing temperature of 130° C.

B: lower limit fixing temperature of 131° C. to 140° C.

C: lower limit fixing temperature of 141° C. to 155° C.

D: lower limit fixing temperature of 156° C. to 160° C.

E: lower limit fixing temperature of 161° C. or more

TABLE 3

| | Spent | | Fogging | | Charge amount | | | Storage stability | | Low temperature-fixing property | |
|---|---|---|---|---|---|---|---|---|---|---|---|
| | Value (%) | a) | ΔID | a) | Mode value (fC/μm) | Peak w. at half h. | a) | Value (mm) | a) | Temp. (° C.) | a) |
| Ex. 1 | 95.3 | A | 0.04 | A | 0.27 | 0.18 | A | 32 | A | 125 | A |
| Ex. 2 | 93.5 | B | 0.05 | A | 0.32 | 0.17 | A | 31 | A | 125 | A |
| Ex. 3 | 90.2 | B | 0.04 | A | 0.31 | 0.17 | A | 25 | B | 120 | A |
| Ex. 4 | 92.3 | B | 0.03 | A | 0.29 | 0.18 | A | 28 | B | 135 | B |
| Ex. 5 | 96.4 | A | 0.03 | A | 0.26 | 0.19 | A | 24 | B | 140 | B |
| Ex. 6 | 90.4 | B | 0.04 | A | 0.28 | 0.18 | A | 30 | A | 125 | A |
| Ex. 7 | 92.4 | B | 0.05 | A | 0.28 | 0.17 | A | 27 | B | 120 | A |
| Comp. Ex. 1 | 60.2 | E | 0.35 | C | 0.13 | 0.31 | C | 18 | C | 150 | C |
| Comp. Ex. 2 | 74.9 | D | 0.32 | C | 0.12 | 0.32 | C | 24 | B | 160 | D |
| Comp. Ex. 3 | 85.5 | C | 0.34 | C | 0.14 | 0.31 | C | 18 | C | 155 | C |

TABLE 3-continued

| | Spent | | Fogging | | Charge amount | | | Storage stability | | Low temperature-fixing property | |
|---|---|---|---|---|---|---|---|---|---|---|---|
| | Value (%) | a) | ΔID | a) | Mode value (fC/μm) | Peak w. at half h. | a) | Value (mm) | a) | Temp. (° C.) | a) |
| Comp. Ex. 4 | 85.3 | C | 0.35 | C | 0.11 | 0.33 | C | 9 | D | 140 | B |
| Comp. Ex. 5 | 85.4 | C | 0.32 | C | 0.14 | 0.31 | C | 12 | D | 165 | E |
| Comp. Ex. 6 | 74.3 | D | 0.32 | C | 0.12 | 0.33 | C | 28 | B | 140 | B |
| Ex. 8 | 93.4 | B | 0.24 | B | 0.16 | 0.28 | B | 24 | B | 140 | B |
| Ex. 9 | 85.3 | C | 0.22 | B | 0.13 | 0.25 | B | 25 | B | 135 | B |
| Ex. 10 | 81.2 | C | 0.26 | B | 0.14 | 0.21 | B | 24 | B | 150 | C |
| Ex. 11 | 85.4 | C | 0.28 | B | 0.13 | 0.29 | B | 26 | B | 140 | B |
| Ex. 12 | 85.5 | C | 0.29 | B | 0.18 | 0.31 | B | 29 | B | 150 | C |
| Ex. 13 | 82.5 | C | 0.24 | B | 0.18 | 0.27 | B | 28 | B | 150 | C |
| Ex. 14 | 93.5 | B | 0.03 | A | 0.29 | 0.17 | A | 18 | C | 125 | A |
| Ex. 15 | 92.4 | B | 0.12 | B | 0.32 | 0.19 | A | 27 | B | 155 | C |

a) Evaluation

As shown in Table 2 and Table 3, toners of Comparative Example 1 and Comparative Example 2, which were produced by an emulsification condensation method using 1,3-propanediol and 2,3-butanediol, respectively, as an alcohol component in the polyester resins, were difficult to solve with wax, which caused carrier spent, decrease of charge amounts, and degradation of charge amount distributions.

The toner of Comparative Example 3, which though used 1,2-propanediol, used unpurified rosin, could not solve sufficiently the problem of carrier spent and fog.

Using 1,2-propanediol could solve these problems (see Examples 1 to 15), however, depending on the softening point of the polyester resins usage of 1,2-propanedilol failed to suppress carrier spent sufficiently (see Comparative Examples 4 and 5).

For solving the problems of decrease of charge amounts and occurrence of fogging, it was found that it is not necessary to use the polyester resins of the present invention for all the toner binders. Instead, in case of the toners with a core-shell structure produced by an emulsification polymerization method, the same effects were found to be obtained by using the polyester resins for only the shell parts (see Examples 6 and 7).

The toner of Comparative Example 6, which has the same polyester resin component profile as the toner of Example 2 but has less amount of 1,2-propanediol contained in it than the toner of Example 2 has, were recognized to cause the phenomenon similar to those caused by the Comparative Examples 1 and 2.

Furthermore, when the physical properties of the external additives adhered to toner surfaces were out of the defined ranges, as were the cases of Examples 8 to 13, it was found that no extreme degradation of low temperature-fixing property and storage stability was caused, and that, however, to some extent electrostatic property degraded due to the degradation of flowability and charge amount distributions also degraded.

When the toner particle diameters were small, as was the case of Example 14, it was found that the average circularity degraded due to difficulty to some extent in the toner production, that heat-resistance/storage stability was more or less poor due to easy melting, and that the degree of fog did not degraded. On the other hand, when the toner particle diameters were large, as was the case of Example 15, it was found that to some extent fixing property and degree of fog degraded.

The toner according to the present invention is excellent in storage stability, low temperature-fixing property, and stability of charge amounts, causes less wax spent and resin spent to carrier particles as well as less occurrence of fog, therefore may be suitably used in image forming apparatuses of electrophotographic methods, image forming methods, process cartridges and so forth.

The image forming apparatus and the image forming method according to the present invention use the toner according to the present invention, can provide extremely high quality images, and therefore may be used widely in, for example, laser printers, direct digital platemakers, full-color copying machines using a direct or indirect electrophotographic multi-color image developing process, full-color laser printers, and full-color fax machines for regular papers.

What is claimed is:

1. A toner produced by emulsifying or dispersing in an aqueous medium particles comprising at least polyester resin particles and by aggregating the polyester resin particles, wherein the polyester resin particles comprise a polyester resin, the polyester resin is produced by condensation polymerization of an alcohol component comprising 65 mol % or more 1,2-propanediol in a dihydroxy alcohol component and a carboxylic acid component comprising purified rosin, and the softening point of the polyester resin is 80° C. or more and less than 120° C., and wherein the toner further comprises a colorant and a releasing agent.

2. The toner according to claim 1, wherein the carboxylic acid component further comprises an aliphatic dicarboxylic acid compound having 2 to 4 carbon atoms.

3. The toner according to claim 1, wherein the alcohol component further comprises glycerin.

4. The toner according to claim 1, wherein the toner comprises a core-shell structure, a core part formed of core particles comprising resin particles A for cores, and a shell part formed of fine shell particles containing resin particles B for shells.

5. The toner according to claim 1, wherein the toner is produced by a method which comprises:

forming core particles by aggregating resin particles A for cores comprising the polyester resin particles by heating;

forming shell-coated particles in which fine shell particles are attached to surfaces of the core particles by adding to a dispersion of the core particles fine shell particles comprising resin particles B for shells; and heating the shell-coated particles.

6. The toner according to claim 4, wherein the resin particles B comprise polyester resin particles.

7. The toner according to claim 1, further comprising: an external additive made of fine inorganic particles attached to toner surfaces, wherein the fine inorganic particles comprise fine silica particles having a hydrophobizing degree of 50% or more and a BET specific surface area of 100 $m^2/g$ to 300 $M^2/g$, and fine titania particles having a hydrophobizing degree of 50% or more and a BET specific surface area of 20 $m^2/g$ to 150 $m^2/g$.

8. The toner according to claim 7, wherein the fine inorganic particles comprise silica particles of an average primary particle diameter of 60 nm to 150 nm and of approximately spherical shapes.

9. The toner according to claim 1, wherein the toner has a weight average particle diameter ($D_4$) of 3.0 μm to 7.0 μm, and the ratio of the weight average particle diameter ($D_4$) to the number average particle diameter (Dn) ($D_4$/Dn) is 1.05 to 1.30.

10. The toner according to claim 1, wherein the toner has an average circularity of 0.93 to 0.99.

* * * * *